US006217207B1

(12) United States Patent
Streich et al.

(10) Patent No.: US 6,217,207 B1
(45) Date of Patent: Apr. 17, 2001

(54) CURRENT CREATING DEVICE AND METHOD FOR LIQUEFACTION OF THICKENED CRUDE OIL SEDIMENTS

(75) Inventors: Bruno Streich, Zuerich; Alexandra Sarah Frei, Winterthur, both of (CH)

(73) Assignee: Lindenport S.A., Collex (CH)

( * ) Notice: Subject to any disclaimer, the term of this patent is extended or adjusted under 35 U.S.C. 154(b) by 0 days.

(21) Appl. No.: 09/180,155

(22) PCT Filed: Apr. 17, 1997

(86) PCT No.: PCT/CH97/00152

§ 371 Date: Dec. 7, 1998

§ 102(e) Date: Dec. 7, 1998

(87) PCT Pub. No.: WO97/41976

PCT Pub. Date: Nov. 13, 1997

(30) Foreign Application Priority Data

May 3, 1996 (CH) ..... 1129/96
Jul. 17, 1996 (CH) ..... 1750/96

(51) Int. Cl.[7] ..... B01F 5/04

(52) U.S. Cl. ..... 366/137; 366/165.5; 366/173.2; 134/168 R; 134/169 R

(58) Field of Search ..... 366/101, 107, 366/136, 137, 165.1, 165.4, 165.5, 167.1, 173.1, 173.2; 134/167 R, 166 R, 168 R, 169 R

(56) References Cited

U.S. PATENT DOCUMENTS

| | | | | |
|---|---|---|---|---|
| 1,192,478 | * | 7/1916 | Vandercook . | |
| 1,978,015 | | 10/1934 | Erdman . | |
| 2,574,958 | | 11/1951 | Carr . | |
| 2,845,934 | * | 8/1958 | Payson . | |
| 4,660,088 | * | 4/1987 | Hara et al. | 366/137 |
| 4,716,917 | * | 1/1988 | Schmidt | 134/167 R |
| 4,859,071 | * | 8/1989 | Woilles et al. | 366/136 |
| 5,061,080 | * | 10/1991 | MacKay et al. | 366/169 |
| 5,078,799 | | 1/1992 | Matter et al. . | |
| 5,301,702 | * | 4/1994 | McKinney | 134/167 R |
| 5,810,473 | * | 9/1998 | Manabe et al. | 366/137 |

* cited by examiner

*Primary Examiner*—Charles E. Cooley
(74) *Attorney, Agent, or Firm*—Walter C. Farley

(57) ABSTRACT

Liquefaction of sludgy to compact sediments (3) in vessels (1) in which crude oil (2) is stored and/or transported uses injecting a liquid above the sediment surface with nozzles (11) so that the sediment is at least partly liquified or dissolved in the liquid such that it can be removed from the vessel (1) together with the liquid. A substantially horizontally flowing liquid current which can be closed on itself is created above the sediment surface by directing the injection through all nozzles (11) such that the injection direction has a horizontal component which is oriented tangentially to a current line of the liquid current being created and is oriented in the flowing direction. The injected liquid is crude oil or a refinery product and differs from the lowest levels above the sediment in that it comprises a smaller share of heavy components.

15 Claims, 20 Drawing Sheets

CURRENT CREATING DEVICE AND METHOD FOR LIQUEFACTION OF THICKENED CRUDE OIL SEDIMENTS

FIELD OF THE INVENTION

This invention concerns a method and device for recovering crude oil bound in thickened crude oil or its sludgy to compact sediments in vessels in which crude oil is stored and/or transported.

BACKGROUND OF THE INVENTION

Crude oil hauled from the ground in crude oil production is first stored without further treatment in storage vessels, i.e., in crude oil tanks of large volume and is held ready for distribution. The storage times of the oil in this kind of vessel is frequently sufficiently long for considerable sedimentation to occur, especially under extreme climatic conditions. The sedimentation speed and the composition of the sediments usually differ according to the origin of the oil. If such vessels are emptied and refilled several times without removing the sediments, a layer of sediments of a thickness of 1.5 m or more can be formed. The quantity of crude oil contained in this kind of sediment layer is considerable because this layer consists to a large extent of thickened oil and higher molecular substances such as, e.g., asphalt, paraffins or waxes. The sediments can, however, also be formed from lighter components of crude oil by means of thickening under the influence of heat. The sediments often have a jelly-like consistency and are nothing else than a heavy fraction of crude oil, the components of which are very mixable with crude oil or lighter components of crude oil or are soluble in these. The sediments, however, also contain foreign matter in form of, e.g., stones or pieces of metal, mostly rust.

For a long time, the sediments in crude oil containers as described above have been unwanted material which still today are removed in periodic cleaning processes from the vessels with suitable cleaning media, mostly aqueous solutions of detergents, is deposed of in more or less sensible manner or is destroyed. In the patent publication EP-160805, a method has been described with which this kind of sediment in crude oil containers or similar storage or transport vessels can be brought into a recyclable form. For this purpose, crude oil is injected into the sediment by means of rotating heads with nozzles which heads are introduced into the sediment. Thus, over a large area the sediment is swirled around and distributed in the liquid, is made to move, and is dissolved at least partly. It proves to be advantageous to match the activities of the individual nozzle heads to each other, such that due to opposite rotation, the vortices created by each nozzle head create currents.

From the named publication (EP-160805) it can be seen that the described method is rather complicated. The reason for this is the necessary use of rotating lances with which a region as large as possible is treated with injected oil and with which the vortices are to be achieved. Regarding the use of energy and in particular regarding the device and the method for assembling it, the whole thing is relatively costly. Means, i.e., drives, for rotating the lances are required. The diluting media, the fresh crude oil must be introduced through these same lances. For the desired forming of eddies, controlling means are required to control the direction of rotation of the lances. Furthermore, this type of rotating lance is complicated mechanically and thus subject to disturbances. If the combined rotation fails the forming of eddies also fails, which, however, is relatively insignificant due to the two-dimensional effect of the rotating nozzles. However, the required simultaneous triple function, i.e., rotating the heads with, e.g., pneumatic means, pumping and injecting the crude oil and controlling the nozzle heads is costly and rather disadvantageous concerning the process. In addition, the construction of rotating lances requires a relatively high precision because roller bearings and other elements requiring narrow tolerances, e.g., for fit are included in the device. This makes designing and manufacturing such devices relatively expensive.

SUMMARY OF THE INVENTION

The inventive method substantially consists in bringing a plurality of liquid jets having a fixed spatial direction into and directly above the sediment by means of hydrodynamic energy such that the introduced liquid forms a substantially horizontal current. The object is to create with the totality of all the liquid jets a concerted current or concerted currents, respectively. The plurality of specifically arranged and directed lances having defined nozzle orientation effect in a vessel with a circular plan e.g. a current which is closed in itself and which behaves as if driven by a gigantic stirrer. Hereby, the upper border of the flowing liquid is to remain as little disturbed as possible and its lower border, i.e., the border between flowing liquid and sediment, is to be formed such that an amplified erosive effect is achieved by the current. In order to keep the energy required for the process as low as possible it is also an object of the method only to create directed mass currents where they are necessary for dissolution of the sediment. An attempt is made to substantially only form a current within a predetermined layer, i.e., in the region just above the sediment layer. It is not necessary to move the liquid above this region. However, due to the inner friction in the liquid this cannot be prevented totally but the additionally required energy is kept low.

Thus, the inventive method consumes less process energy than known methods and is simpler to carry out. The device to be created for carrying out the inventive method is much simpler and is easier to operate than the corresponding device for the known method and it is in particular more easily adapted to and mounted in the vessels to be treated. The required means are very simple, are cheaply fabricated, easily mounted, robust, little susceptible and practically maintenance-free lances.

The liquid introduced directly above the sediment differs from the crude oil above the sediment at least in that its concentration of substances from the sedimentation is lower. This liquid, in the case of a crude-oil tank, is, e.g., crude oil from the upper region of the vessel or a less concentrated portion of the same crude oil, i.e., a portion of crude oil from which the heavy components have been removed. In any case, the main components of the liquid are the same as the main components of the liquid to be stored and/or transported in the vessel to be treated. Therefore, the liquid, after taking up the sediments can be mixed into the stored liquid without scruples and/or can be fed into the same further processing.

The inventive method makes use of the finding that by suitable supply of current energy (hydrodynamic energy) it is possible to produce a current in a region or a layer of a resting liquid, whereby a kind of shear planes are formed between the flowing layer and the resting layer above or below the flowing layer or between the flowing layer and layers above and below which flow at different speeds. In order to form this kind of flowing layer the liquid to be introduced is injected into the resting liquid in a direction substantially tangential to the flow axis and at a predetermined speed. For this purpose, the pressurized liquid is pressed through stationary injection nozzles which are correspondingly orientated in a fixed direction.

It is advantageous if, at least in the region of the upper shear plane, mixing is impeded as far as possible; this for the following reason: in vessels in which crude oil or liquids of similar character are stored in a stationary condition for a sufficiently long time not only sediments form but probably also a composition gradient across the whole height of the liquid column such that the concentration of the substances most concentrated in the sediment increases from top to bottom. The lowermost layers of liquid thus contain a considerable concentration of the substances contained in the sediment and therefore, are hardly suited for an efficient re-liquefaction of the described sediments. With the inventive method it becomes possible to introduce a new liquid above the sediment and to mix it with the lowest layers of the stored oil only to a limited degree which means that the inventive method is of a higher efficiency than known methods.

If a liquid from the layer above the circular current layer and more suitable for the liquefaction is injected into the circular current layer a certain mass current is formed on the shear plane from the circular current layer into the superposed region above the shear plane or a corresponding quantity of liquid is continuously drawn from the circular current layer, i.e., the quantity of the injected liquid. Thus, the continuity condition for the circular current layer is maintained.

The sediments generally have a landscape-like, uneven surface which alone causes an increased dissolving effect on the lower border of the flowing layer. Additionally, some or all of the injection nozzles can point downward at a shallow angle such that the introduced liquid is injected directed slightly towards the sediment surface, i.e., not quite horizontally, by which a local vertical flow component is favored.

An example of an embodiment of a device for carrying out the inventive method substantially consists of a plurality of hollow lances for guiding the crude oil to be injected. These lances can be introduced into the vessel to be treated in a substantially vertical direction, through the sediment also and advantageously down to the floor of the vessel. The end region of each lance orientated toward the floor of the vessel has at least one nozzle arranged laterally on the lance, advantageously several such nozzles arranged above each other in spaced relationship. The other end of each lance protrudes from the top of the vessel and is connectable to a supply line for pressurized liquid. The nozzles arranged on one lance are all pointed in the same direction. A further embodiment shows two rows of nozzles extending axially and having a radial angle between them. The lances are positioned such that one part of the nozzles is positioned above the sediment surface and the other part below the sediment surface. This is, e.g., realized with lances which comprise rows of superimposed nozzles, wherein the length of the rows of nozzles is advantageously so large that the nozzles can rise above thick sediment layers.

The lances distributed over the base area of the vessel are positioned substantially vertically in the vessel such that the end regions of the lances which are equipped with the nozzles reach as far down towards the floor of the vessel as possible, i.e., they are introduced into the sediment layer. All lances are orientated such that the ejecting directions of their nozzles have a component, e.g., directed in the same direction tangentially relative to a predetermined current center (or to a different central region). For cylindrical vessels, the flow center is located advantageously on the vessel axis.

When the lances are positioned, the nozzles are appropriately orientated, the lances are connected to the supply system and the liquid is pressed into the vessel through the nozzles. The liquid is thereby pressed particularly through nozzles located above the sediment surface because pressing through other nozzles meets a considerably higher resistance. Due to the orientation of the nozzles as described above, a substantially horizontal current develops above the sediment after some time, e.g., in form of a flowing liquid layer which mainly consists of freshly supplied liquid. This liquid interacts with the sediment surface and erodes it, whereby the sediment surface is lowered and further nozzles contribute to the general flow of liquid directly on the surface of the sediment.

Through the current such generated and developing into, e.g., a circular current, the liquid is transported into the region of other nozzles located in flowing direction (downstream), wherein it is enriched with the sediment substances to be liquefied and is then displaced upwards by the freshly supplied liquid.

In this manner, the sediment can be removed right down to the floor of the vessel. Heavy, insoluble sediment components such as stones, pieces of metal, rust or the like will hardly leave the region of the floor due to the small but inevitable turbulence and they can be removed from the floor in a separate process.

For static reasons, storage tanks for crude oil usually have a circular base which is extremely suitable for carrying out the inventive method because there are no corners where the liquid is not agitated. All the same, it is possible to apply the inventive method in vessels with other shapes also, wherein the current to be created, which follows a path as closed on itself as possible, advantageously flows in parallel with the vessel wall.

BRIEF DESCRIPTION OF THE DRAWINGS

The inventive method and the inventive device are explained in detail with reference to the following drawings wherein.

DETAILED DESCRIPTION OF PREFERRED EMBODIMENTS

Figure 1:
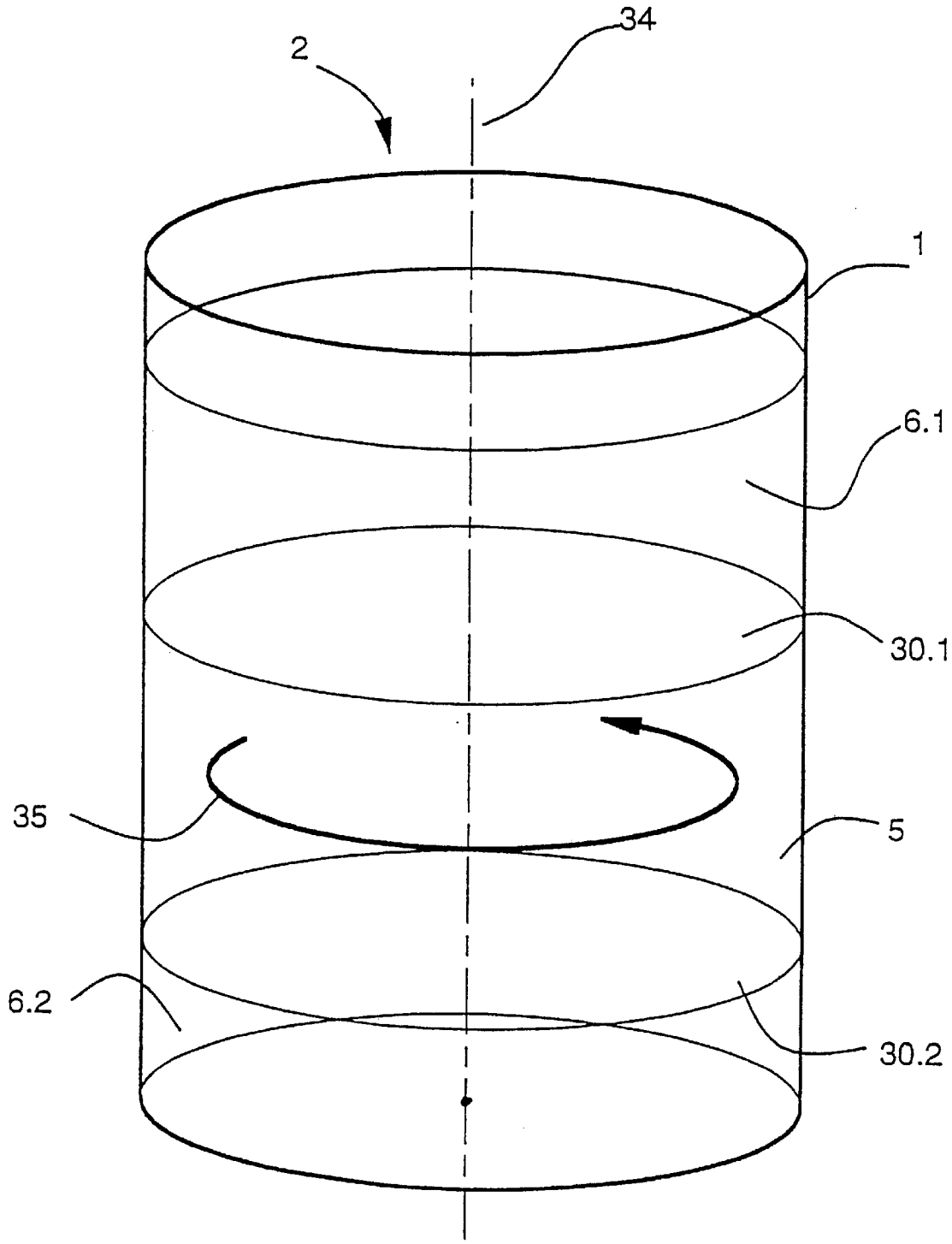
FIG. 1 is a perspective view of a typical storage tank showing the principle of a moving circular current layer with adjacent shear planes in a cylindrical container containing a liquid.

FIG. 1 shows a schematic representation of the idealized principle of a liquid layer driven in a circle. The figure shows a cylindrical vessel 1 with a central axis 34 representing the center of the current. Vessel 1 contains a liquid 2 which is divided into layers. Layers 6.1 and 6.2 are layers of liquid 2 at rest relative to vessel 1. Between these two resting layers there is a layer 5 in which the liquid is in motion. The direction of motion of the layer is indicated by arrow 35. The layer moves in substantially circular form, i.e., there is a circular current in layer 5 around central axis 34 of vessel 1. The circular current is a current without eddies or turbulence. The current field within the layer is homogenous and consists of horizontal motion components only.

Because layer 5 moves relative to layers 6.1 and 6.2, shear planes 30.1 and 30.2 form between resting layers 6.1 and 6.2 and circular current layer 5. As mentioned above, FIG. 1 illustrates an ideal system in which friction between the shear planes is neglected. In reality, most shear planes are characterized by shearing strains due to the horizontal relative movement of the adjacent liquid layers and friction within the liquid. The friction forces being oriented substantially tangentially to the outer wall of vessel 1 may cause slight movement in layer 6.1 or 6.2, ideally at rest relative to vessel 1, or at least movement in one part of the layer which is directly adjacent to moving layer 5. For better understanding, these secondary effects are neglected in what follows.

In FIG. 1 the means which introduce the necessary energy into the layer to be moved are not shown because the actual embodiment is not important here and it is the intention to show the principle of the circular current layer only.

Because circular current layer 5 comprises few eddies, i.e., has components running substantially tangentially to the outer wall of the vessel, the energy needed for creating and maintaining this current is small. The current has a small energy loss because the liquid mass in layer 5 moves homogeneously and without forming eddies. It is even possible for the user of the method to select the thickness (or height) of the circular current layer or column by using the inventive device and thus the user has the possibility to bring only such a part of the liquid mass into motion or keep it in motion as is necessary for the method. This reduces the energy consumption (e.g., pump power) of the system further and to a considerable degree.

Figure 2:
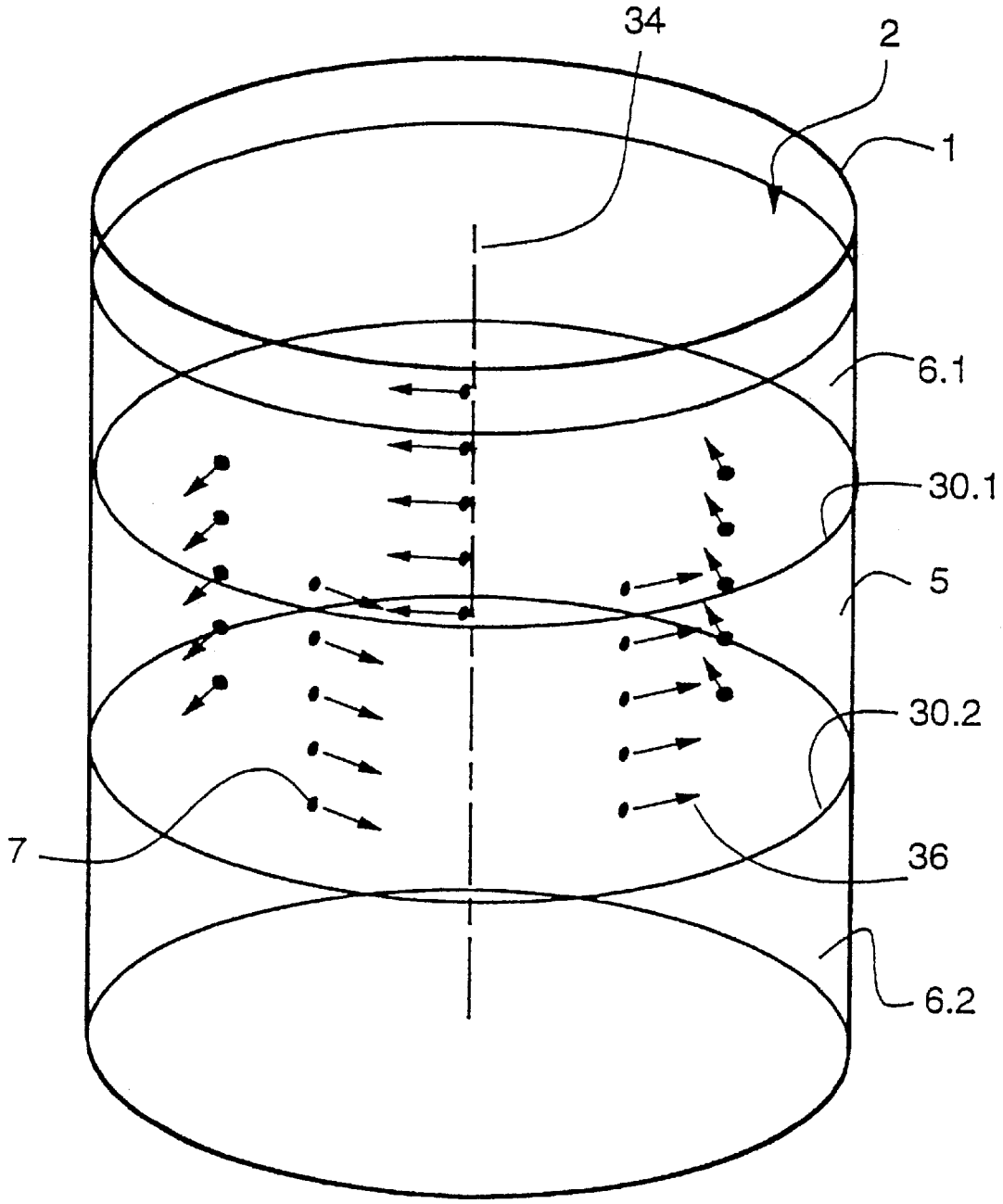
FIG. 2 is a perspective view similar to FIG. 1 showing the principle of creating a circular current layer.

FIG. 2 schematically shows the (again idealized) principle of the energy supply into circular current layer 5. The thickness of circular current layer 5 is substantially determined by the arrangement of the means for supplying the motion energy to the liquid (in the following called motion energy sources 7). In the figure, motion energy sources 7 are shown as points from which a directed liquid jet or a directed liquid acceleration issues. Arrows 36 show the direction in which the liquid is accelerated or moved by the motion energy sources 7. Here, nozzles or elements supplying motion energy to the system in the sense of FIG. 2 are used to inject liquid.

The present invention is concerned with the energy supply into the liquid by means of injecting liquid stemming from the resting layers 6.1 or 6.2 or advantageously from the circular current layer itself, which liquid is pressed through the nozzles by means of a pump. This method is described in detail in connection with FIG. 3.

The orientation of circular current layer 5 is substantially influenced by the orientation of motion energy sources 7. This orientation is visualized in the figure by means of arrows 36. In FIG. 2 the arrows are orientated such that, viewing the vessel from the top, a counter-clockwise circular current is created. The arrows point substantially in the flowing direction, i.e., tangentially to the wall of the vessel.

The dimension of circular current layer 5 in the longitudinal direction of vessel 1 is substantially dependent on the extension of the motion energy sources 7 in the direction of the longitudinal axis 34 of the vessel, which axis is at the same time the center of the current. In order to create a distinct circular current layer 5, it is advantageous if motion energy sources 7 are distributed as uniformly as possible over the height, the radius and the circumference of the circular current layer 5 to be created. In FIG. 2 motion energy sources 7 are arranged in five rows of superimposed sources at uniform distances. The figure shows the principle arrangement only. Optimum arrangements are discussed exhaustively in connection with some of the following drawings.

Figure 3:
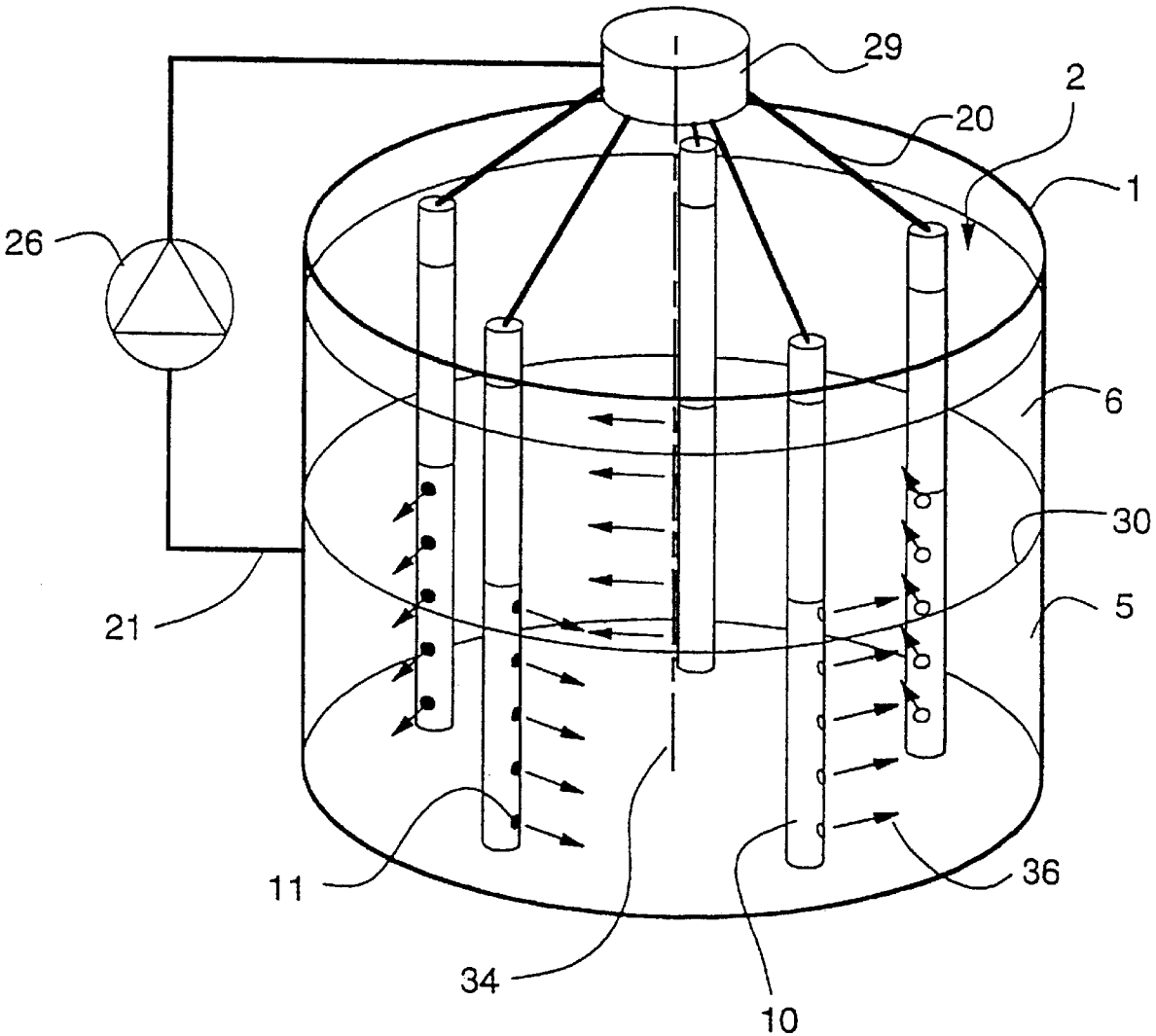
FIG. 3 is a simplified perspective view of a tank with lances having nozzles and showing the principle of creating a circular current layer in the lower part of the cylindrical tank with the inventive lances.

FIG. 3 shows schematically the inventive principle of the injection of liquid into a circular current layer 5 of a cylindrical crude oil tank 1 with a central axis 34 forming the current center around which the liquid of moving layer 5 flows circularly. Lances 10 are immersed into tank 1 through the top surface of the liquid. These lances reach down to the region of the floor of tank 1. Lances 10 comprise rows of nozzles which reach from the ends of lances 10 adjacent the floor of the tank to shear plane 30. The nozzles serve as motion energy sources (7 in FIG. 2).

In FIG. 3 several lances 10 are arranged regularly on a circle concentric with the base area of the tank. Lances 10 are orientated such that the axes of nozzles 11 are orientated substantially parallel with the base area of the tank. The openings of nozzles 11 are aimed in the direction of motion of the circular current.

The upper ends of the lances protruding out of the tank are connectable to a supply system, which in FIG. 3 is schematically shown as supply lines 20, a distributor 29, a pump 26 and a suction means in the region of the moving circular current layer. Thus, it is possible to suck liquid from the circular current layer and to pump this liquid into individual lances 10 from where it can be re-injected into moving layer 5 through nozzles 11.

Liquid 2 which is pumped through a nozzle creates a liquid jet which is shown by means of arrow 36. If lances 10 are introduced into liquid 2 in the arrangement and orientation as described above, motion energy is introduced into layer 5 such that, at constant pump power, after a certain time, a substantially stationary circular current, as described in connection with FIG. 1, is created with the difference that a lower resting layer (6.2 in FIG. 1) cannot form due to the arrangement of the lances as shown in FIG. 3. Using the arrangement described in FIG. 3, a stationary layer 5 with a circular motion is created at the bottom of the tank.

The arrangement and the quantity of lances 10 shown in FIG. 3 merely show the principle of the inventive device for creating a circular-current layer. Crude oil tanks typically have diameters between 30 and 100 m. It is evident that with such dimensions many more lances must be positioned for creating a circular current layer. It is evident also how essential it is to save pumping energy when such large amounts of liquid are to be pumped.

Figure 4:
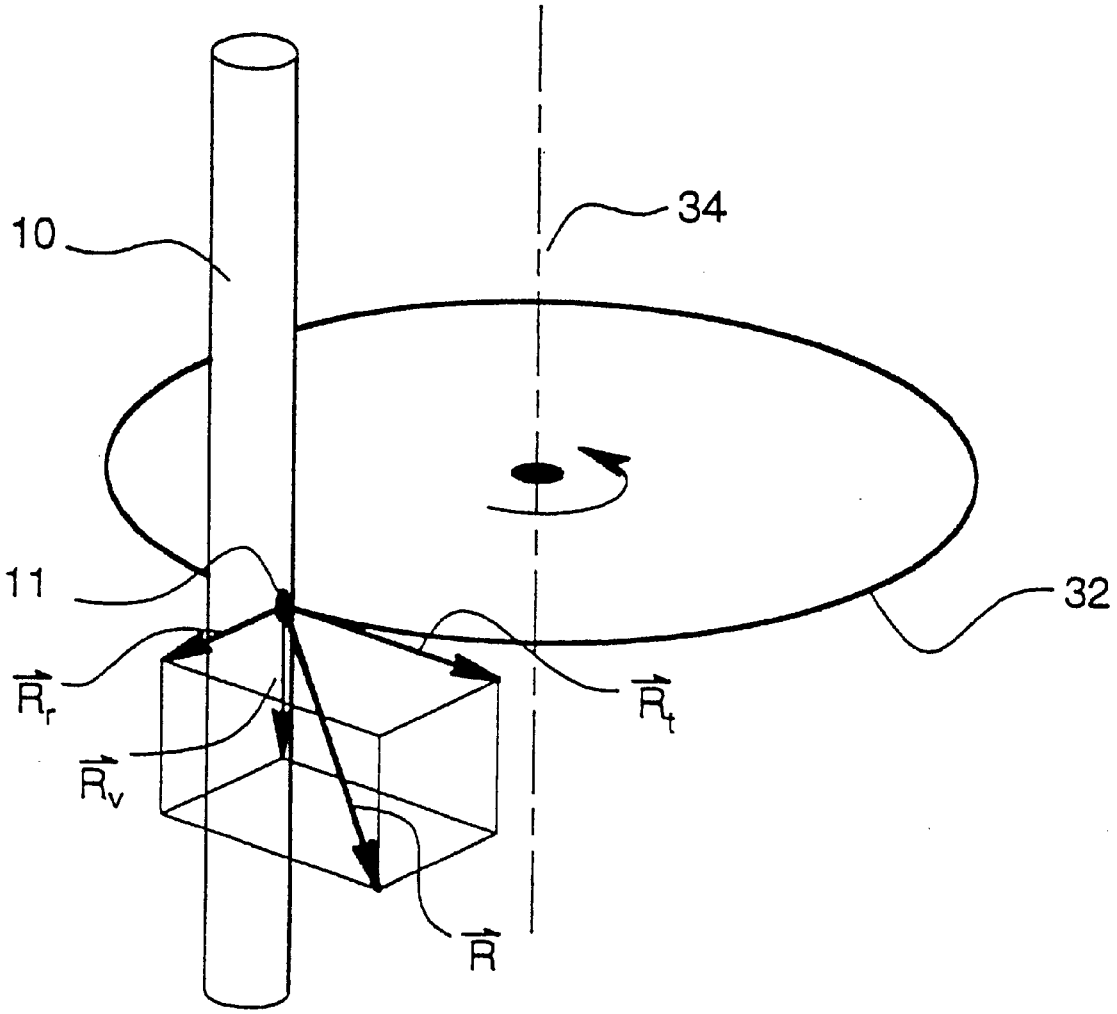
FIG. 4 is a vector diagram showing the principle orientation of lance nozzles for creating currents.

FIG. 4 schematically shows the orientation principle for the nozzles. The drawing shows one lance 10 with one nozzle 11, a predetermined current center 34 and a horizontal circle 32 around the current center, with the nozzle opening located on this circle. Circle 32 is an example of a current line of a horizontal current closed on itself, i.e., a circular current around current center 34. The jet direction is shown at a somewhat exaggerated angle and is denominated with vector R resolved into a vertical component $R_v$, a horizontal, tangential component $R_t$ (parallel or tangential with the current line) and a horizontal, radial component $R_r$, (perpendicular to the current line).

The conditions for orientating the nozzle and for carrying out the inventive method are the following:

Vector R has an optional vertical component $R_v$, a component directed orthogonally downward.

Vector R has a horizontal, tangential component $R_t$ so that the components of all nozzles of the system have the same sense of rotation relative to the current center.

Vector R can have a horizontal, radial component $R_r$. This component is shorter than the horizontal, tangential component $R_t$, i.e., the angle between the tangent on circle 7 and the horizontal projection of R is at most 45'.

Figure 5:
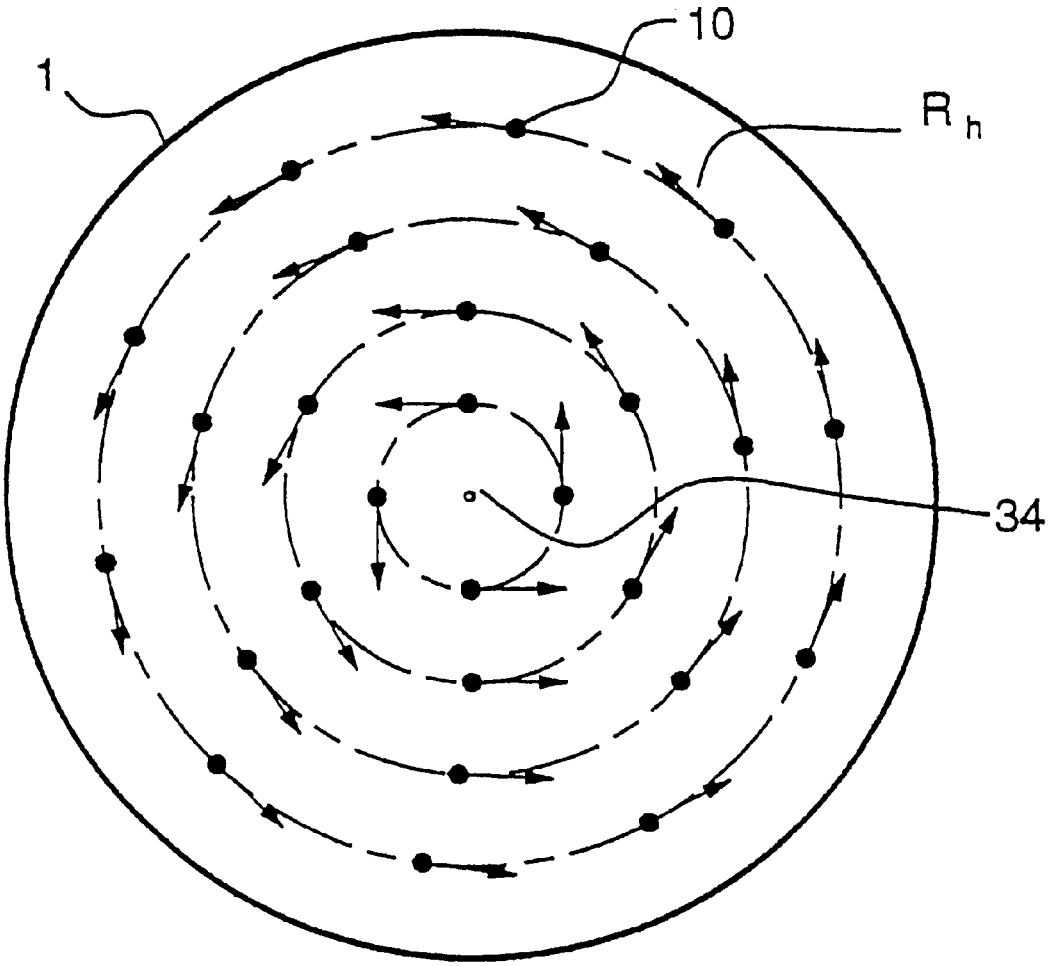
FIGS. 5, 7 and 8 are schematic top plan views of three lance and nozzle arrangements in vessels with different base areas.

FIG. 5 shows a top view of a vessel with a circular base area or floor and with a current center 34 extending perpendicular to the center of this base or floor. However, it must be taken into account that with radii of up to 50 m the curved current lines look like straight lines in smaller segments and that the arrows look exaggeratedly large in this drawing which has a radius of only a few centimeters. However, they correspond to about double the ejection capacity of the nozzles such that the successive formation of the current can be well imagined.

Over the base of the vessel, a plurality of vertically positioned lances 10 is arranged on concentric circles in a substantially regular pattern. The ejection directions through the nozzles are also shown, or the horizontal components $R_h$ of these directions, all of them being arranged tangentially and counter-clockwise (no component $R_r$). The shown nozzles can be individual nozzles on each lance which are then advantageously arranged at different heights or they can be arranged in rows and be orientated all in the same direction, as shown in FIG. 3. The nozzles can be directed, apart from horizontally (parallel to the floor), downward in identical or different angles $\alpha$. It may be sufficient to arrange nozzles only on the outer third of the vessel radius such that a closed current is first created in the region of the vessel wall which then gradually expands inwardly. In order to influence the inner region, the nozzles can be radially orientated instead of tangentially such that the currents forming between the nozzles meet in the center in a radial manner.

Figure 6:
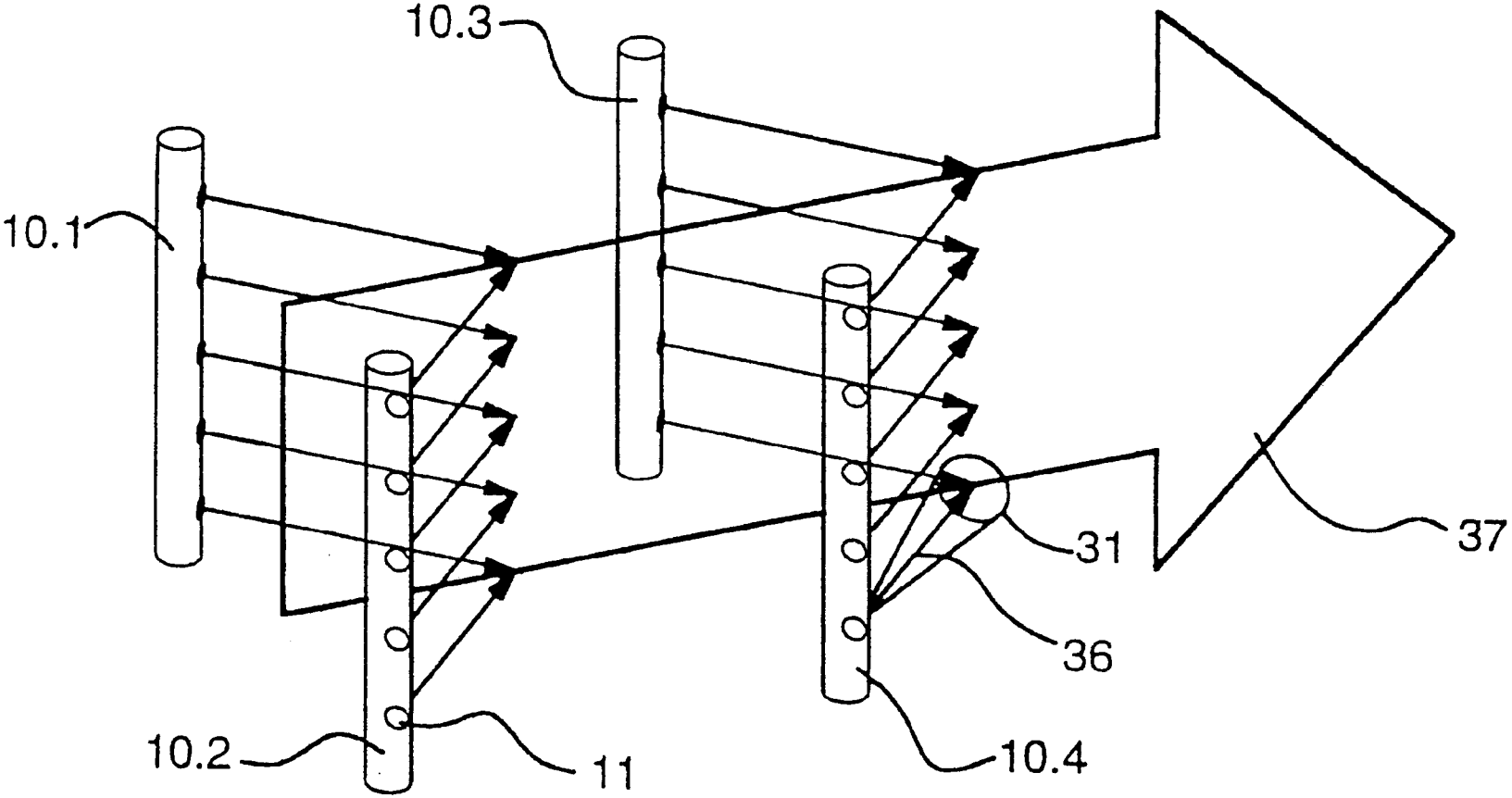
FIG. 6 is a vector diagram showing the principle of the transfer of currents between pairs of successive nozzles.

FIG. 6 shows the possibility for creating a distinct liquid current with the help of the inventive method with 'steady' lances 10. It must be taken into account that, with the immense dimensions of crude oil tanks, the curved current lines look like straight lines if, as mentioned above, only a section of a few meters of the same current is looked at. For this reason, the main flow direction achieved by means of the corresponding arrangement of the lances is shown curved or not curved respectively in FIG. 6.

The lowermost part of a lance arrangement of four lances 10.1, 10.2, 10.3 and 10.4 is shown schematically. Nozzles 11 arranged above each other form rows of nozzles extending vertically at one end of lances 10 adjacent the floor of the tank. The nozzles are shown as rings. The liquid pressed out of the nozzles and the direction of the liquid jets are shown by arrows 36. Obviously, it is a pointed cone 31 with a larger or smaller opening angle according to the nozzle form which is formed when the liquid is pressed out (indicated on one of the nozzles in FIG. 6). Arrows 36 indicating the liquid jets relate to the cone axes, although the actual jets have the form of slender funnels.

Arrows 36 of two adjacent lances (10.1 and 10.2 or 10.3 and 10.4, respectively) not only have a component in the direction of main current 37 but also a component directed toward the main flowing direction. The ejected liquid of lance 10.1 thus meets the liquid jets of lance 10.2 in the region of the main current and accelerates the liquid in this region. The supplied energy decreases with the distance that the liquid moves away from the lance. At a distance from lances 10.1 and 10.2 where the driving energy has decreased to a high degree, a further pair of lances 10.3 and 10.4 is positioned in the liquid in the same manner as lances 10.1 and 10.2, such that the desired main current 37 is maintained or, depending on the distance between the pairs of lances, is even accelerated. The course of main current 37 is influenced by the geometric arrangement of the pairs of lances (10.1 and 10.2 or 10.3 and 10.4, respectively) and by the pressure of the ejected liquid. Thus, currents can be created in a tank with a circular base or a base of different shape.

In a crude oil tank of a diameter in the range of 30 to 100 m, a jet range of more than 5 m can be achieved within the crude oil using an ejection pressure of 5 to 30 bar. Therefore, it is advantageous to maintain the distances between the lances, in particular the tangential distances between the lances, within this range.

Figure 7:
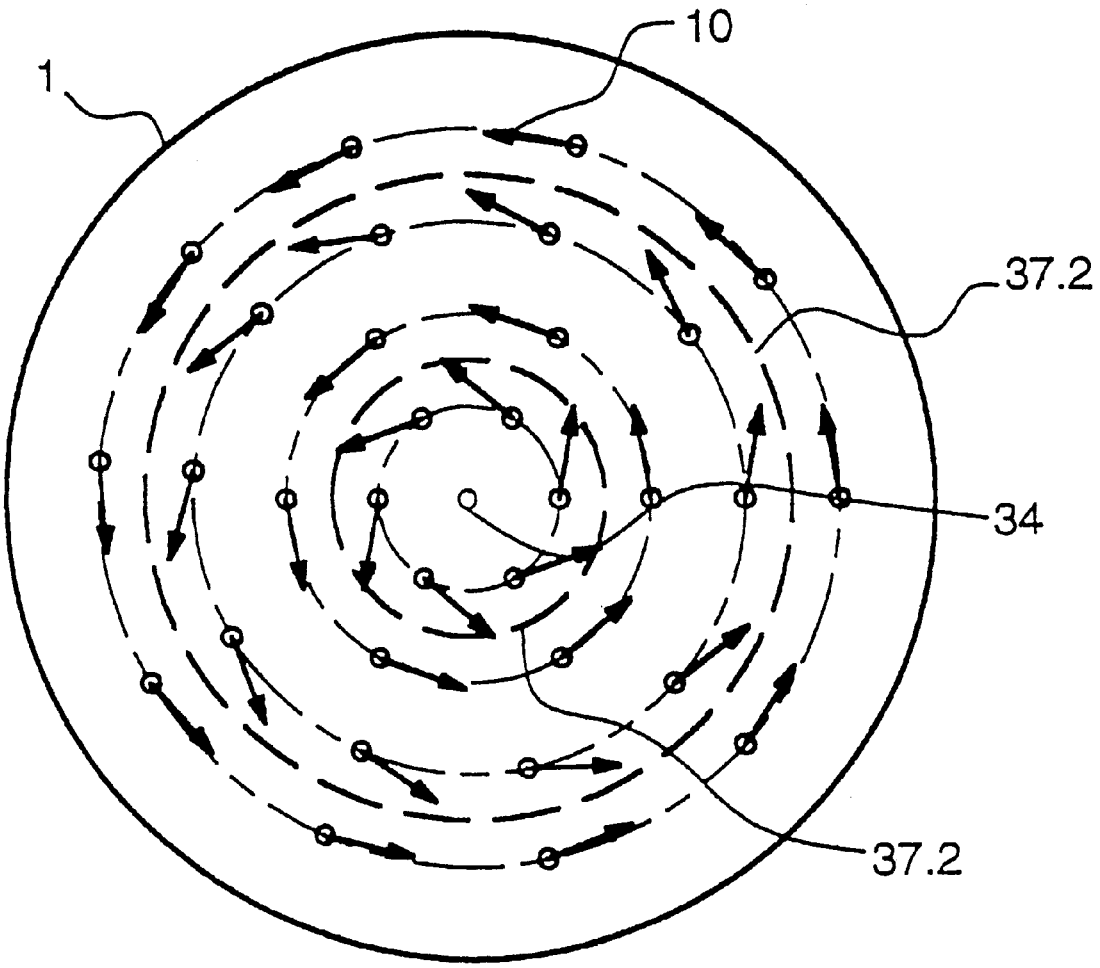

FIG. 7 shows a further top view into a vessel in which lances 10 with nozzles are arranged substantially on four current lines (shown by means of broken lines) of a current to be created. The nozzles of the lances of two adjacent current lines are each orientated slightly toward each other (with radial components directed towards each other, as shown in FIG. 6) such that between the current lines of a pair of lances a main current develops.

Figure 8:
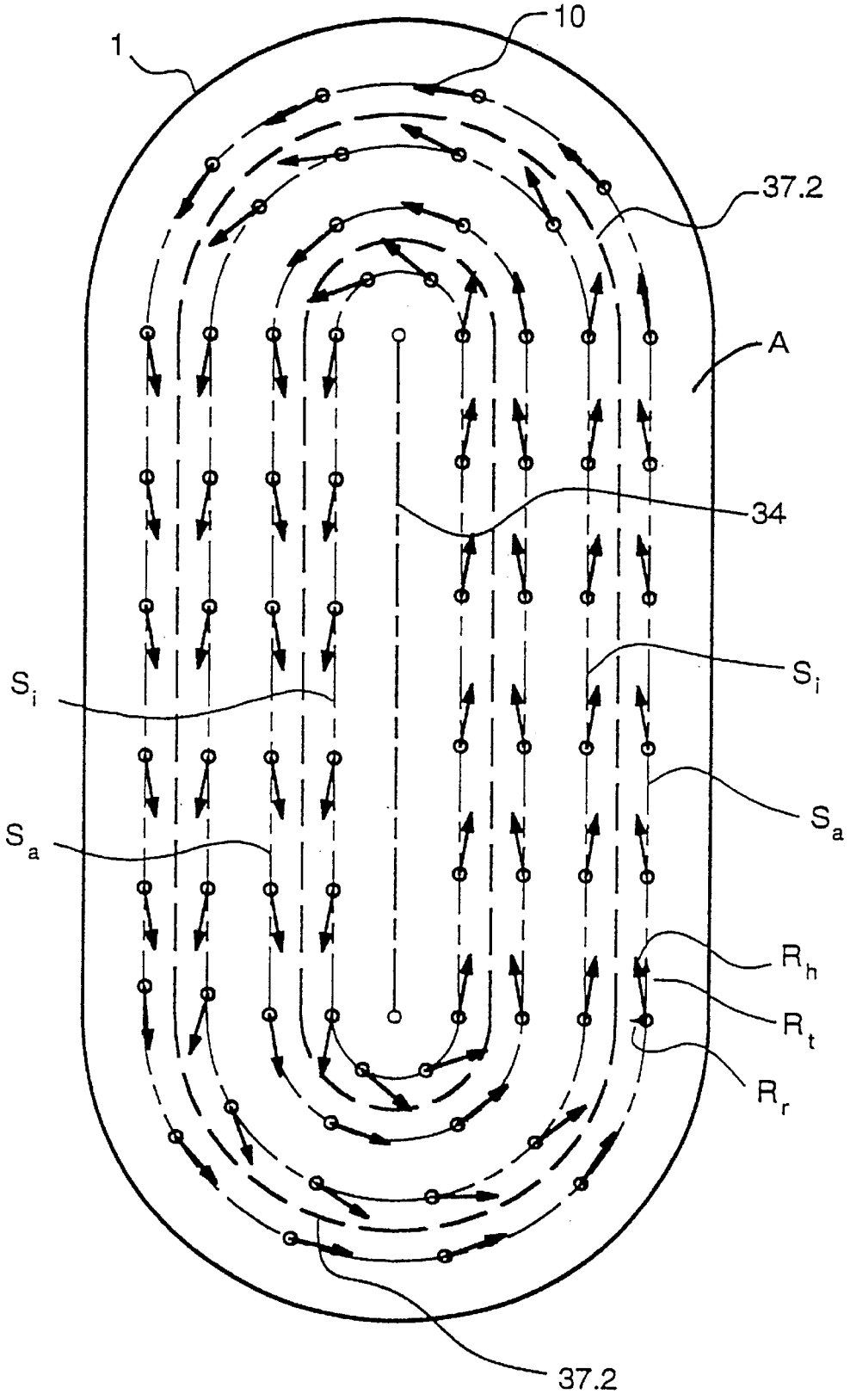

FIG. 8 shows a top view of a vessel which does not have a circular base but an oval one. Within the vessel, vertical lances 10 with nozzles are arranged. The liquid current to be created by injecting liquid is again closed on itself and for covering as much of the base area as possible it is not arranged around a current center but around a 'rotation area' 34. The lances are substantially arranged on inner current lines $S_i$ and outer current lines $S_a$ of this liquid current and the nozzles are orientated such that the corresponding jet directions have a horizontal, tangential component $R_t$ and a horizontal radial component $R_r$, wherein the radial components $R_r$ of the nozzles on the inner current line $S_i$ is directed outwardly and the radial component $R_r$ of the nozzles on the outer current line $S_a$ is directed inwardly.

With the arrangement shown in FIG. 8, a main current is created between the inner and outer current lines, whereby unwanted forming of eddies in the region of current area A along the wall of the vessel is prevented which means that the pumps use less energy.

Figure 9:
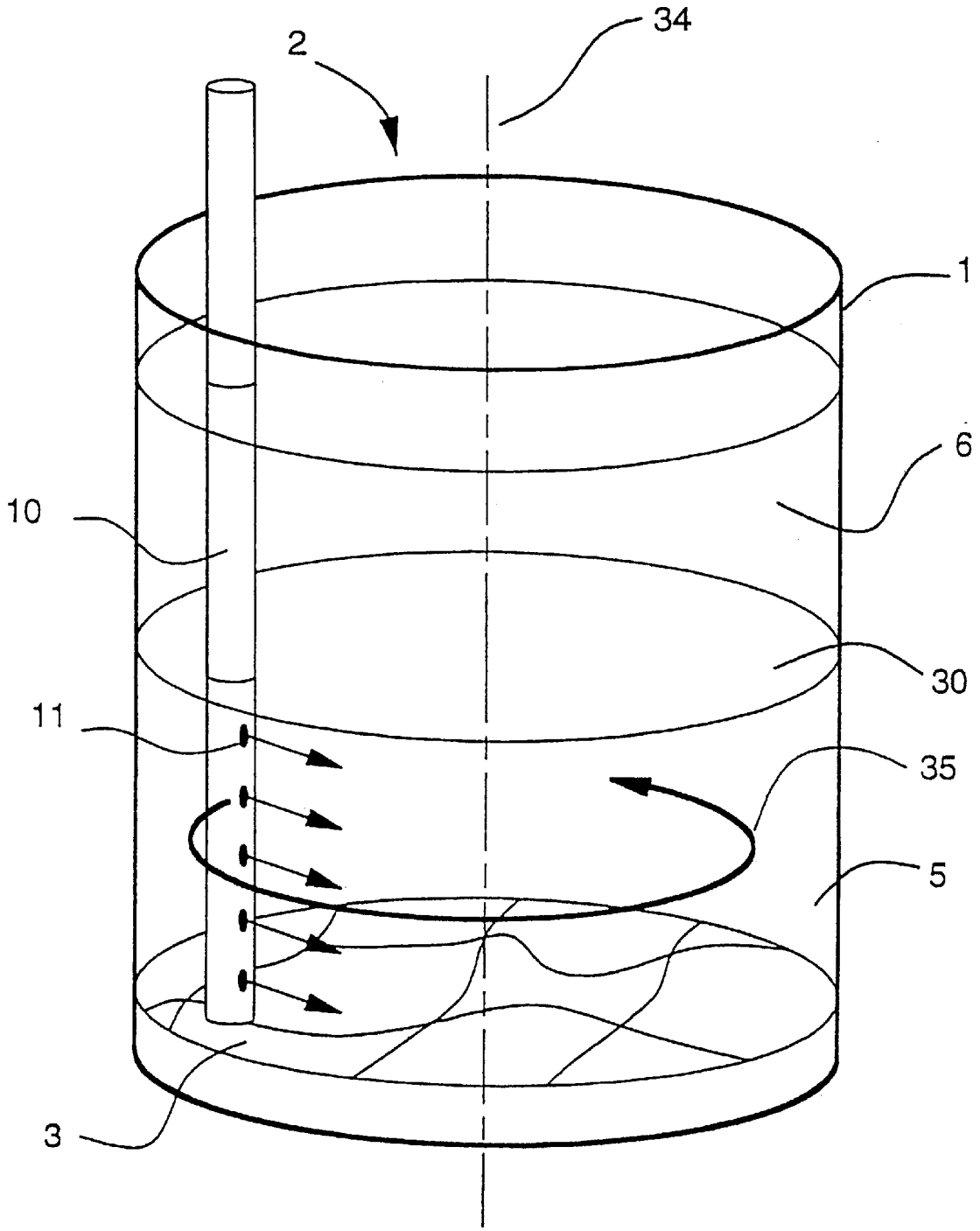
FIG. 9 is a perspective view similar to FIG. 1 showing the creation of a circular current above a sediment layer.

FIG. 9 shows a schematic representation of a crude oil tank 1 with a sediment layer 3 at the bottom of tank 1. The drawing shows an embodiment of the inventive method and the inventive device for liquefaction of crude oil sediments.

On one end of each of lances 10 (in FIG. 9 only one lance is shown as an example) have only one nozzle 11, a small number of nozzles 11 or a short line of nozzles arranged close together, and the nozzles are not introduced into the sediment layer but only reach down to its surface. Circular current layer 5 extends above the sediment surface and the current erodes and gradually liquefies or dissolves the sediment. During the dissolution of sediment layer 3, lances 10 are lowered step by step until they reach the tank floor. In a crude oil tank with a floating roof this can, e.g., be realized by means of suitable lowering of the liquid level (pumping out of crude oil). The injected liquid can be crude oil from the upper part of circular current layer 5, fresh liquid or crude oil from upper resting level 6.

If fresh liquid or crude oil from layer 6 is injected without liquid being removed from the layer, there will be a mass transfer in the region of the shear plane as the continuity equation for level 5 would otherwise not be fulfilled. Instead of a distinct shear plane 30, a more or less diffuse and less distinct transition region may form in such a case.

Figure 10:
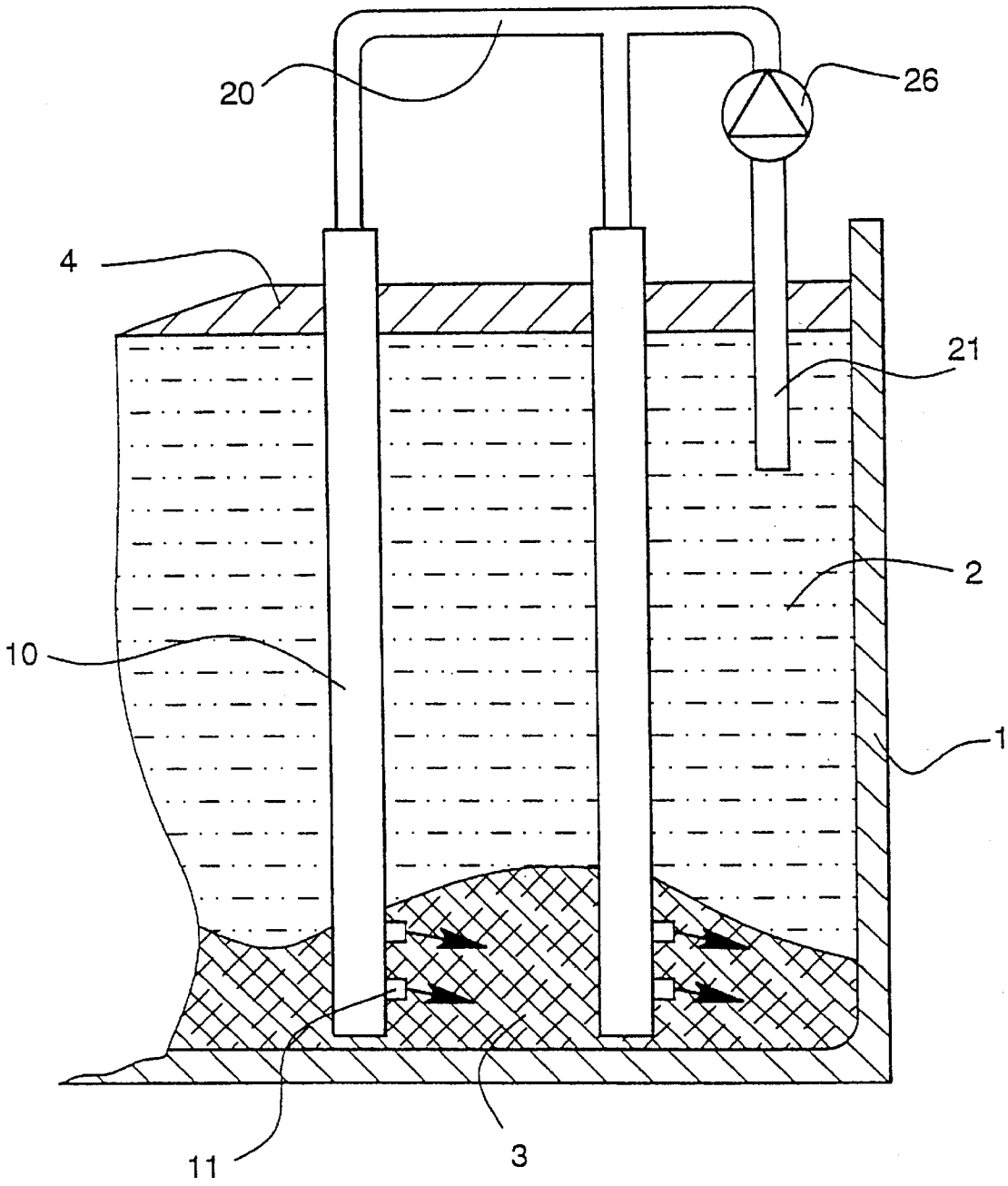
FIG. 10 is a schematic partial side elevation of a storage tank with lances showing the injection of liquid into the sediment layer.

FIG. 10 shows a schematic section through a part of a crude oil tank 1 with a further embodiment of the inventive device for liquefaction of crude oil sediments. The drawing shows two lances 10, each with a row of nozzles comprising at least one nozzle 11 on the lower end of the lances adjacent the floor of crude oil tank 1. Supply lines 20, a pump 26 and means 21 for removing oil by suction are also shown schematically. Lances 10 are, e.g., positioned through openings in floating roof 4 provided for the supports and are lowered down toward the floor of tank 1 and locked in this position. Needless to say, for an actual, immensely large crude oil tank, a large number of lances is to be used.

The injected liquid (here crude oil from the upper layers in tank 1) is pressed through nozzles 11 into the sediment layer consisting of thickened crude oil which gradually dissolves or liquefies due to the contact with crude oil from the upper region of tank 1. During the gradual liquefaction of sediment layer 3, individual nozzles 11 and a part of the nozzle rows gradually becoming larger emerge from the remaining sediment layer 3 and create a circular current layer directly above the sediment layer which current layer additionally accelerates the decomposition of sediments 3. Only foreign matter in the form of, e.g., stones, metal pieces and most of all rust remain on the floor and can be removed from the tank by means of a separate process. The circular current layer which can now form without disturbance prevents renewed formation of a sediment layer.

Figure 11:
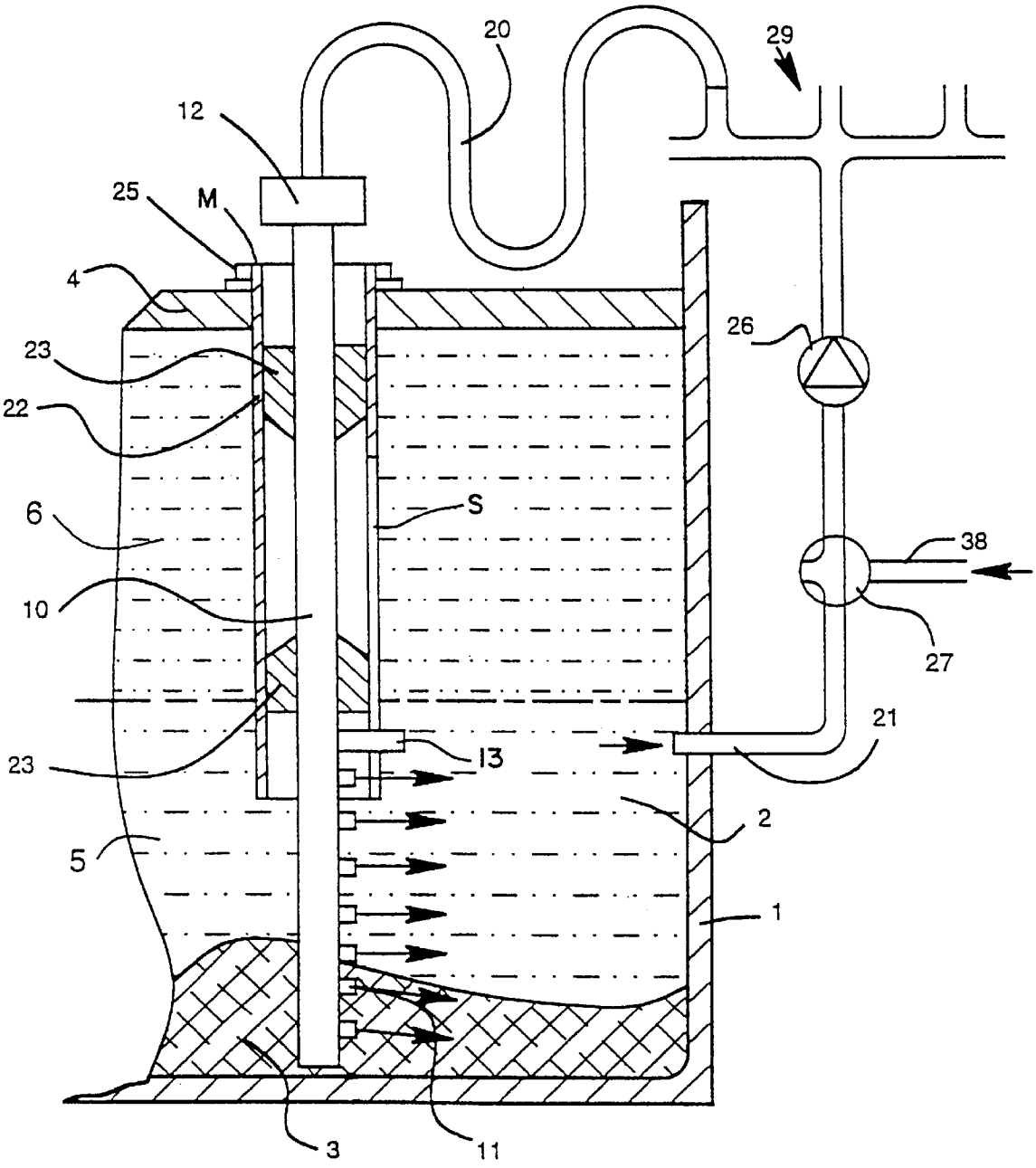
FIG. 11 is a schematic partial side elevation in section of an advantageous embodiment of the lances in a crude oil tank and through a lance system.

FIG. 11 shows schematically a preferred embodiment of the inventive device for carrying out the inventive method. The crude oil tank shown in section has a floating roof 4 and contains crude oil 2 stored above a sediment layer 3. Tank 1 is equipped with a number of lances 10 arranged as demanded by the inventive method for creating a circular current layer above the sediment layer 3. Only one lance is shown in FIG. 11 as an example. These lances extend through liquid layer 2 into sediment layer 3 and down to the floor region of the tank. Lances 10 comprise rows of superimposed nozzles which extend from the end of the lances adjacent the floor of the tank to the liquid layer above the sediment layer. The lances are designed and positioned such that they create a circular current layer 5, as described in connection with FIG. 3, above the sediment layer.

The other ends of lances 10 protrude from the vessel and are connected to a supply system which is shown schematically by a supply line 20, a distributor 29, a pump 26 and means for oil removal by suction 21. Between the means for oil removal 21 and pump 26, a three-way valve 27 can be provided. Depending on the position of the valve, fresh oil from a fresh oil supply 38 or oil removed from the tank by suction is pumped and injected through the lances. In such tanks, oil is not removed by suction at a location in the tank wall but, e.g., an immersion pipe. The means for removing oil by suction as shown only serves for illustrating how, for maintaining the mass equilibrium, crude oil is removed from the driven layer (the circular current layer).

Crude oil tanks often have floating roofs which float on the liquid surface and are spaced a distance from the tank floor which varies with the liquid level. In order to prevent the floating roof 4 from sinking right down onto the floor of the tank, the roof is equipped with stilt-like supports on which the roof is supported when the liquid level sinks below a minimum. The distance between roof and floor then substantially corresponds to the height of the supports. It is advantageous to introduce and position lances 10 through the openings provided for the supports. A big advantage of the inventive device is the fact that, by means of pipe adapters 22, it can easily be adapted to different openings for such supports as are standard in different countries. The use of this kind of very simple, cheap and maintenance-free pipe adapters allows, when applied in connection with a lance adapter 23, the same lances to be used in different countries and it reduces adaptation work to a minimum. The slotted pipe adapters 22 may be reinforced and may replace the supports.

The nozzles or the ejection direction of the liquid jets from the lances respectively can be oriented according to the inventive method in the most various ways, e.g., the nozzles can be orientated by orientating a fixed mark M on pipe adapter 22 on an angle scale 25 which is stationary relative to the floating roof. The orientation for the assembly of lances can be optimized in a computer simulation. According to a calculated plan, the lances are then individually orientated and locked. It is also possible to carry out multi-stage operations in which, after a certain working time, part of the lances or all of them are brought into different relative positions in order to achieve currents of different character, e.g., for vessels of complicated form.

Adapter pipe 22 has a slot S with a length adapted to the length of the nozzle row in order for the liquid to be ejected from the nozzles unhindered,.even if the nozzle row is positioned within the adapter pipe. A possible guidance between adapter pipe 22 and lance 10 is shown in FIG. 11 by a guide element 13. Lance adapter 23 forms a link between the pipe adapters 22, which are different in size depending on the support standard, and the lances 10, which can be designed to be one only size and are not dependent on any support standard. This is a further reason why the inventive device is comparatively cheap in production.

If desired, the lances can be moveable relative to the adapter pipe 22. With such moveable lances, variations in the height of the liquid level do not displace lances 10, or the rows of nozzles on lances 10, relative to tank 1 or to sediment layer 3 lying on the tank floor. Thus, the lance system is adaptable to variations of the liquid level in tank 1 in a very simple manner. No complicated readjusting needs to be carried out. This, in a very simple manner, makes the method extremely maintenance friendly.

Lances 10 are pushed axially through elements 23 and nozzles 11 in the lower region of lances 10 are kept in the region of the tank floor with weight elements 12 which are, e.g., attached to the upper regions of the lances. The mass of weight elements 12 is adapted to the mass of lances 10 such that lance 10 is pushed into sediment layer 3 without further effort or such that the lower ends of lances 10 remain in the region of the tank floor when the liquid level in tank 1 is lowered or raised.

Figure 12:
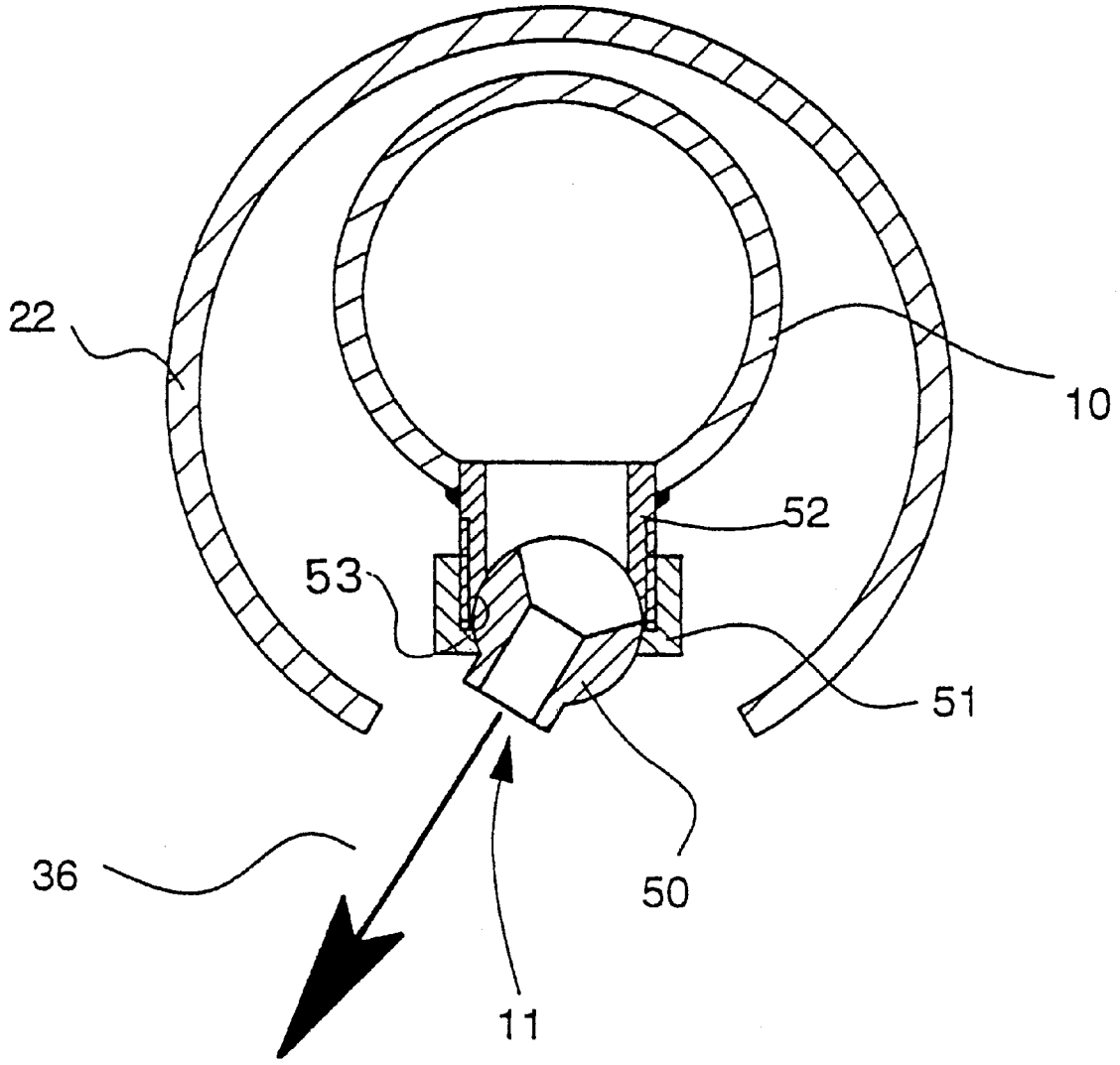
FIG. 12 is a transverse sectional view of an embodiment of a nozzle movable in two axes.

FIG. 12 shows a section through an embodiment of a lance 10 with a nozzle 11 attached to it and through pipe adapter 22. This embodiment of the nozzle comprises a ball-and-socket joint for adjusting the direction of ejected jet 36 to a limited degree. A pipe 52 with an external thread and with a ball socket 53 is attached in the wall of lance pipe 10. The actual ball nozzle 50 is located in the ball socket and is held in position by a union nut 51. It is-advantageous if the dimensions of the lance nozzle system is smaller than the inner dimensions of the pipe adapter. Thus, it is possible to remove the lances from the pipe adapter by pulling them upwardly.

It is important that the position of the nozzle does not change, e.g., under the influence of vibration. For this purpose, a simple nut locking device or other means to prevent loosening of the union nut can be used. It can be advantageous to increase friction between the ball nozzle 50 and counterparts 51 and 52 by rough surfaces or even teeth. It can also be advantageous if these elements have a surface such as is found on untreated cast steel parts.

The elements shown in FIG. 12 can be produced with a minimum accuracy. The shown embodiment demands no special tolerances, apart from what concerns the thread. Therefore, it is possible to use very cheap manufacturing methods and cheap materials (e.g., St-37, GGT), It is evident that the cross section of the lances need not necessarily be circular. It can be imagined that the cross section of lance 10, as described in connection with FIG. 15, can be quadrangular or can have any other form, as will be shown further below.

Figure 13:
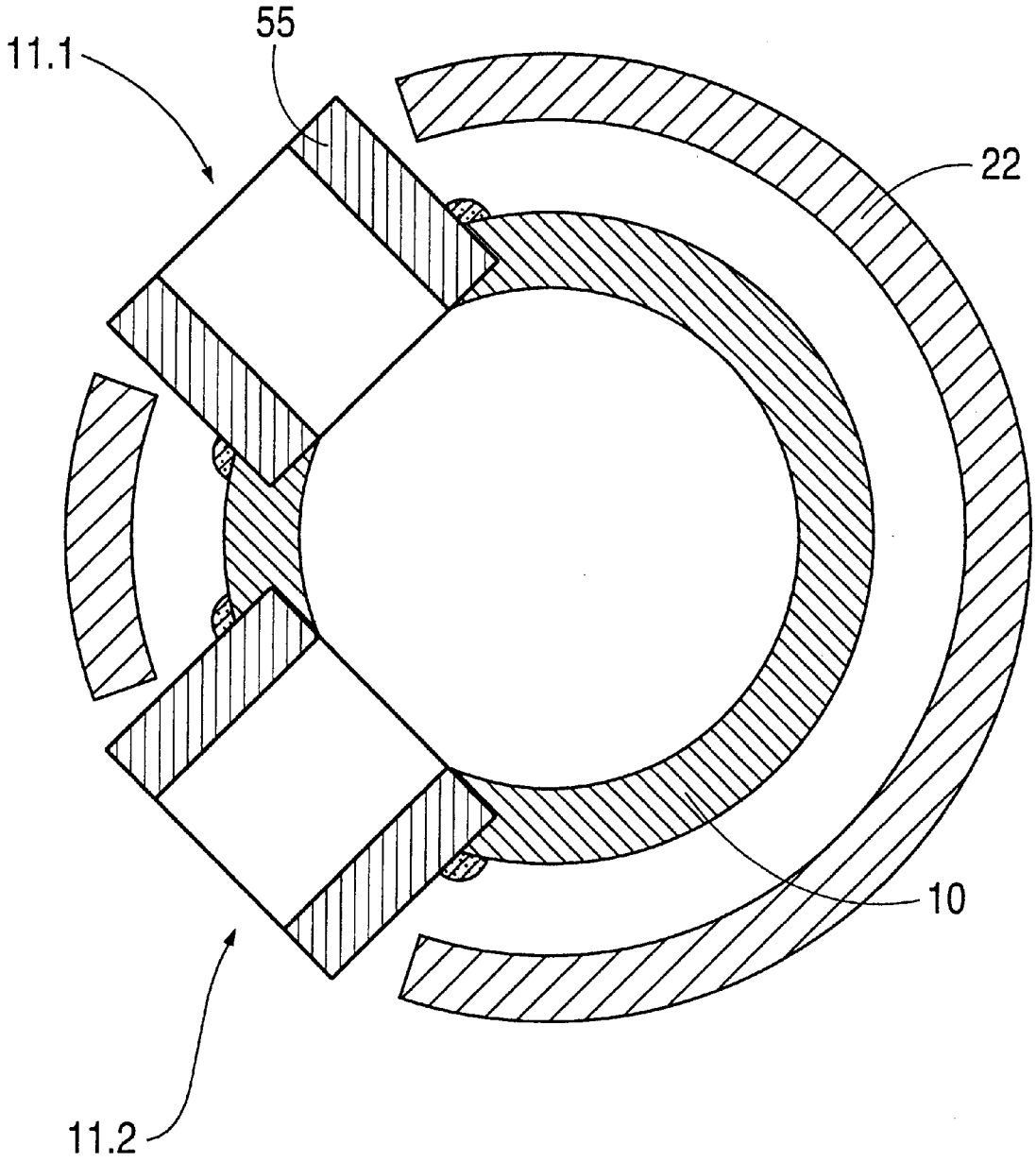
FIG. 13 is a transverse sectional view of a lance with two rows of nozzles pointed in different directions.

FIG. 13 shows a further embodiment of a lance nozzle system. A lance 10 has two rows of nozzles 11.1 and 11.2 pointing in different directions. The individual nozzles, or at least one of the two in each row, can, of course, be adjustable, as shown in FIG. 12 or can be rigid, as shown in FIG. 13. The shown embodiment can be constructed simply and most cheaply with tolerances in the millimeter range using standard profiles.

Figure 14:
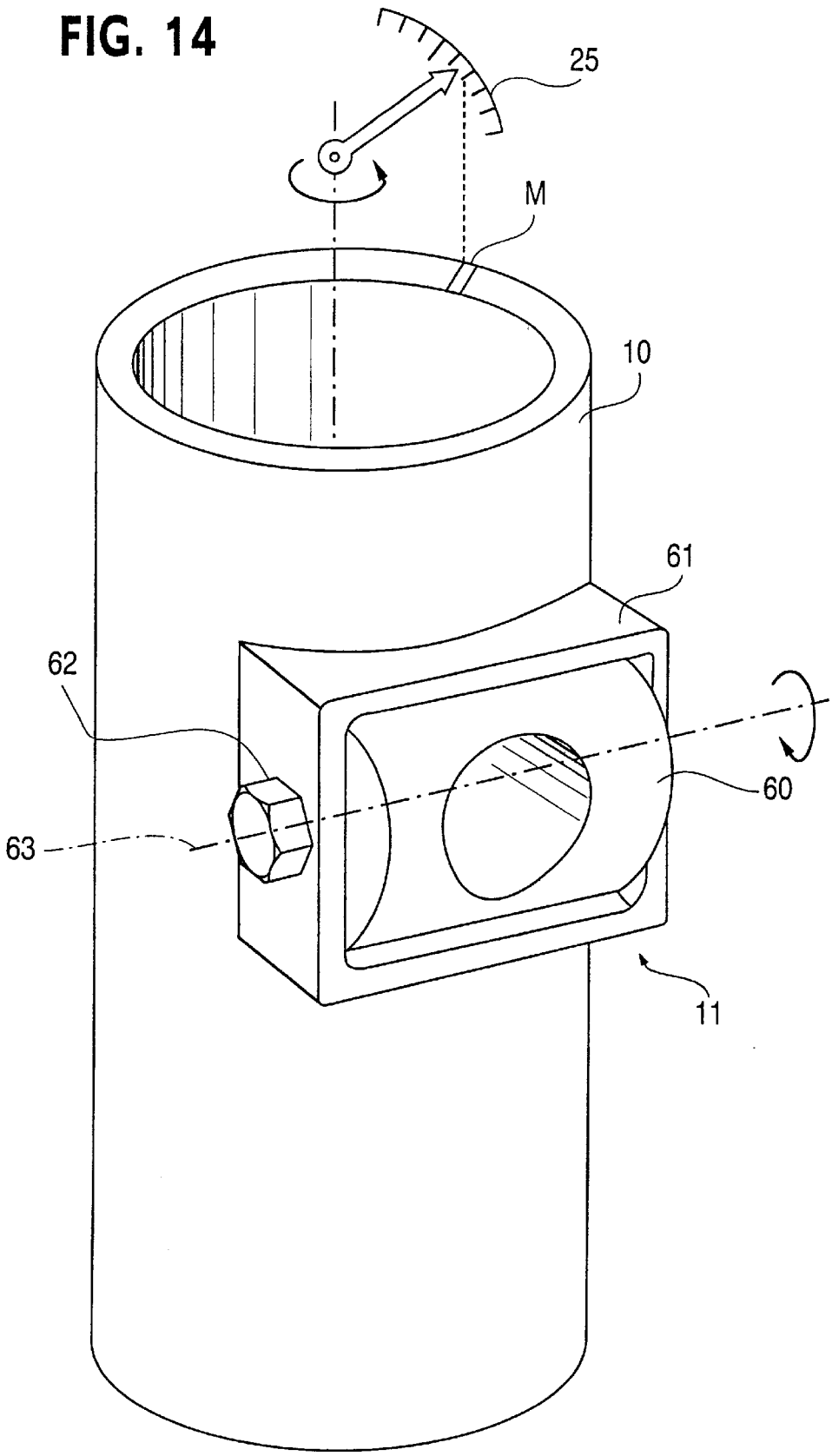
FIG. 14 is a perspective view of an embodiment of a nozzle system rotatable relative to a lance around a generally horizontal axis.

FIG. 14 shows an embodiment of a further lance nozzle system which allows adjustment of nozzles 11 around an adjusting axis 63. The body which forms nozzle 11 comprises a shaft piece with a suitable bore serving as nozzle 11 and with two lateral bores with internal threads defining adjusting axis 63 together with corresponding bores in a rectangular pipe piece 61 fitted to the lance. Here, it is again possible to exclusively use cheap standard parts and standard profiles and to work with production tolerances which are much less tight than is usual in general mechanical engineering. This embodiment allows adjusting the nozzle direction horizontally by turning the lance around its longitudinal axis (indication by mark M on scale 25) and vertically by turning the nozzle around adjusting axis 63.

Figure 15A:
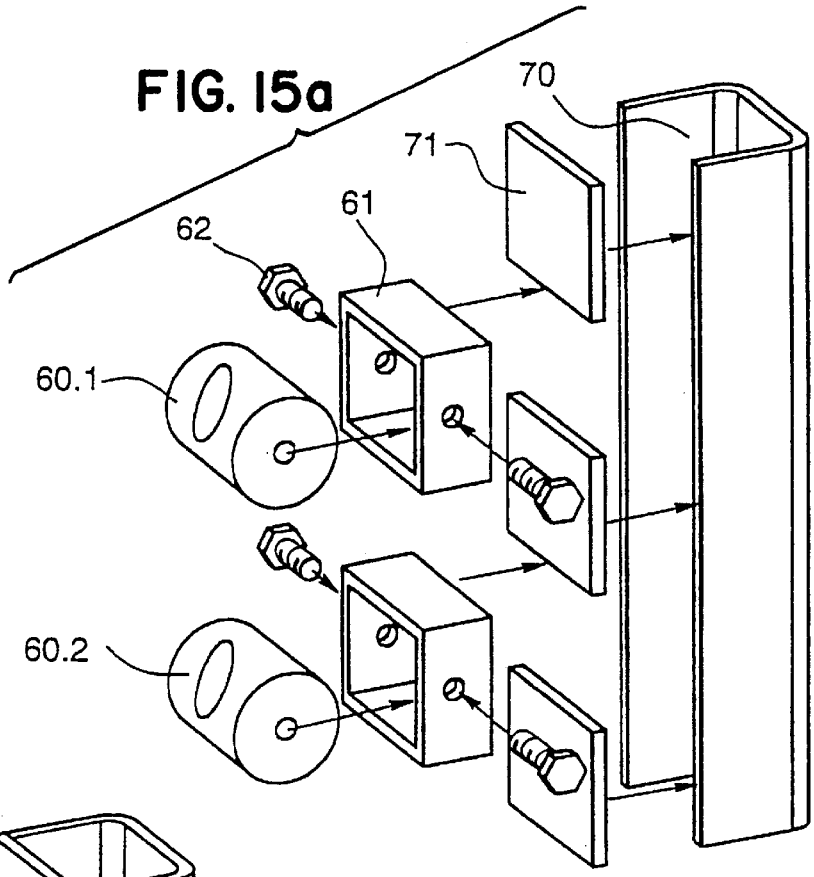
FIGS. 15*a*, 15*b* and 15*c* are respectively exploded perspective, perspective and transverse sectional views of a cheap, robust and simple embodiment of the end portion of a lance with a row of nozzles movable about one axis.
Figure 15B:
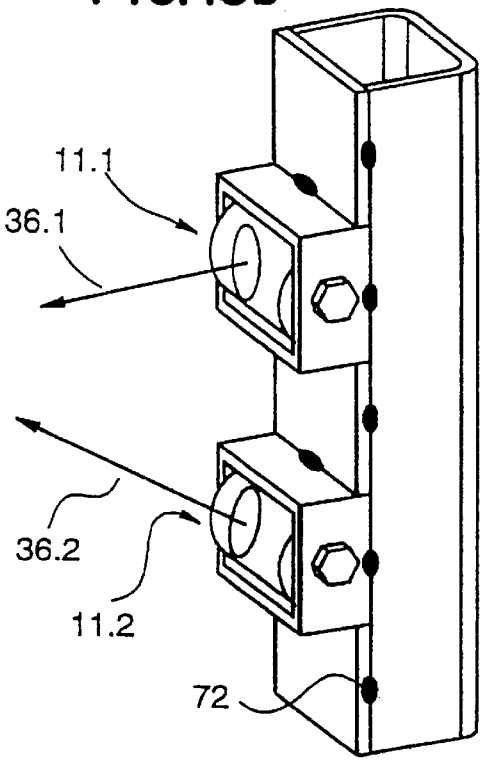
Figure 15C:
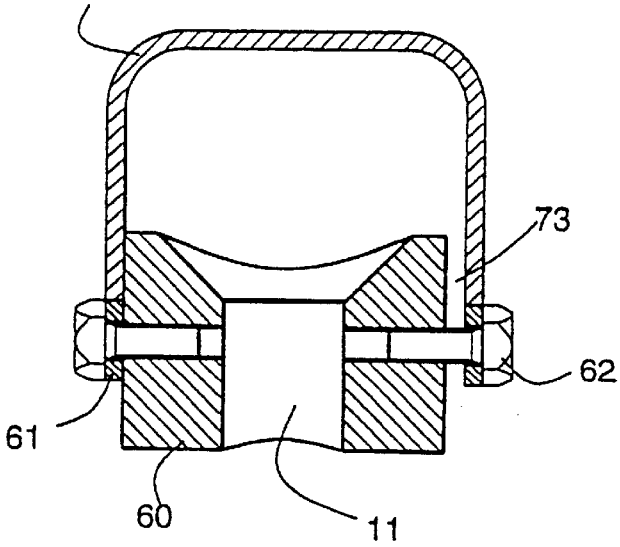

FIGS. 15*a, b*, and *c* show an exploded view and assembled views of a further embodiment of a lance nozzle system according to the same principle as described in connection with FIG. 14. This embodiment has been simplified such that the process for manufacturing the lances is as simple as possible. All used elements such as rod material 60, hollow support 61, bolts 62, plates 70 and U-profile 71 are standard elements or can be manufactured simply from standard profiles (e.g., profile made of weldable steel, such as St-37). Plates 71 are attached to the U-profile, sections 61 of the hollow support are fitted to it by weld points 72, and bored nozzles 60 are bolted in. The foot piece of the lance is closed with a plate 71, the upper part of the lance is closed with a corresponding long plate 71 as a side wall, the elements for the liquid supply are mounted and the lance is completed. Here it is again possible to work with very broad manufacturing tolerances (FIG. 15*c*). E.g., a gap 73 of several millimeters between disc-nozzle 60 and rectangular piece 61 of pipe is permissible because this does not substantially influence the total function of the lance. When welding the individual parts together, it is sufficient to do this with relatively short weld points 72; complicated closed welding in the region of the rows of nozzles is not required.

Figure 16:
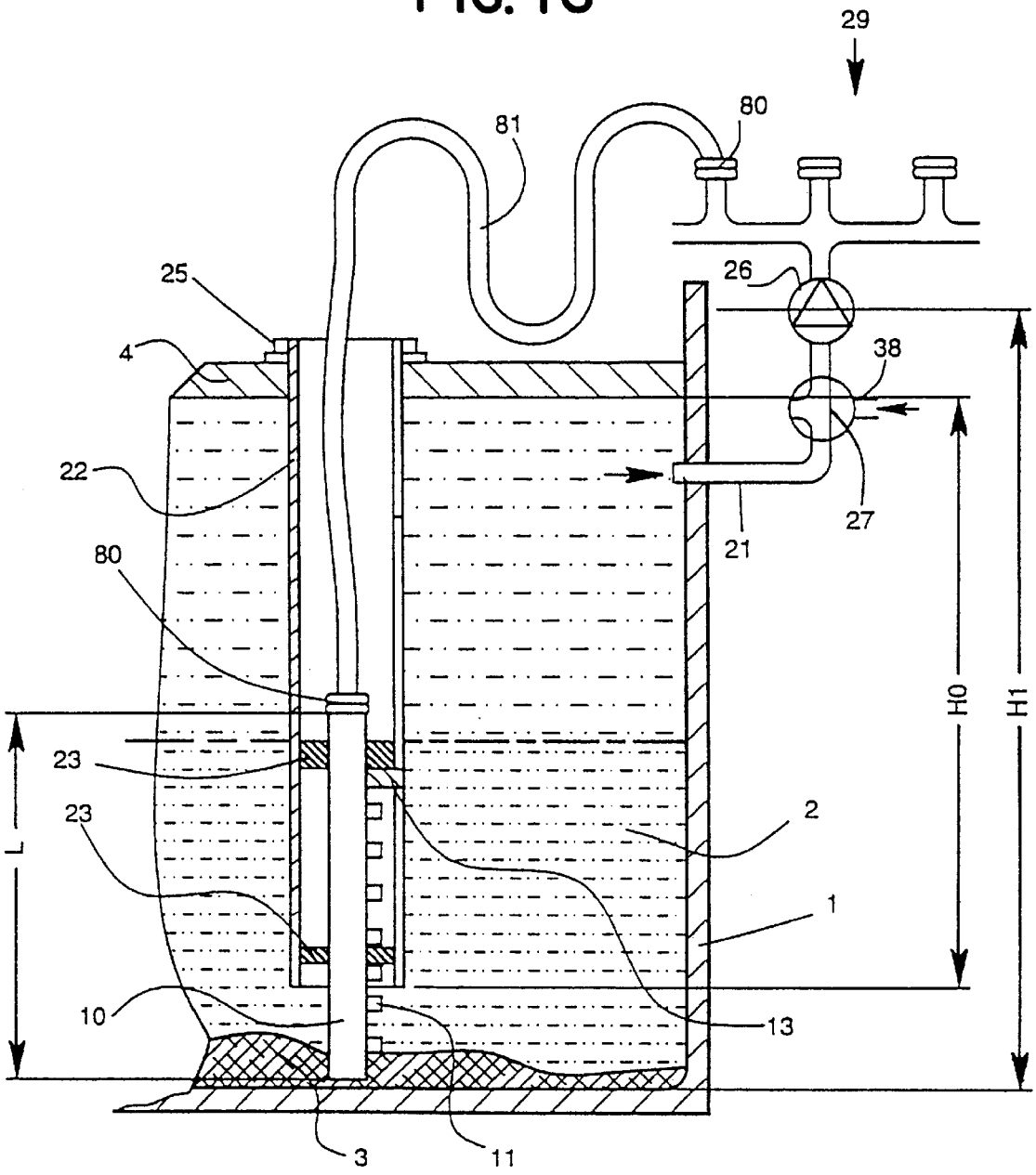
FIG. 16 is a side elevation, in section, of a storage tank with one embodiment of a lance partly comprising a flexible tube.

FIG. 16 shows an example of an embodiment of a lance 10 which is designed with a relatively stiff structure containing nozzles 11 and a relatively flexible tube 81 connected to the rigid part of lance 10 by a hose coupling 80. The rigid part with the rows of nozzles is guided in pipe adapter 22 with lance adapters 23 and guide element 13. Pipe adapter 22, which is matched to the standard support openings of the concerned country, is slotted over its whole length for introducing or removing lance 10 from the top. The advantage of this kind of design or a similar one is its reduced weight and the fact that the stiff part of the lance is considerably shorter than a whole lance consisting of stiff material. Therefore, it is much simpler to handle (transport, store, assemble). Again, standard components can be used for the stiff part of the lance with at least one row of nozzles and standard flexible tubes 81 with standard couplings 80 are available on the market.

It is important that the length of the stiff part of the lance be larger than the difference between the maximum liquid level H1 and the minimum liquid level H0 in order to make sure that lance 10 is guided through pipe adapter 22 at any liquid level.

Figure 17B:
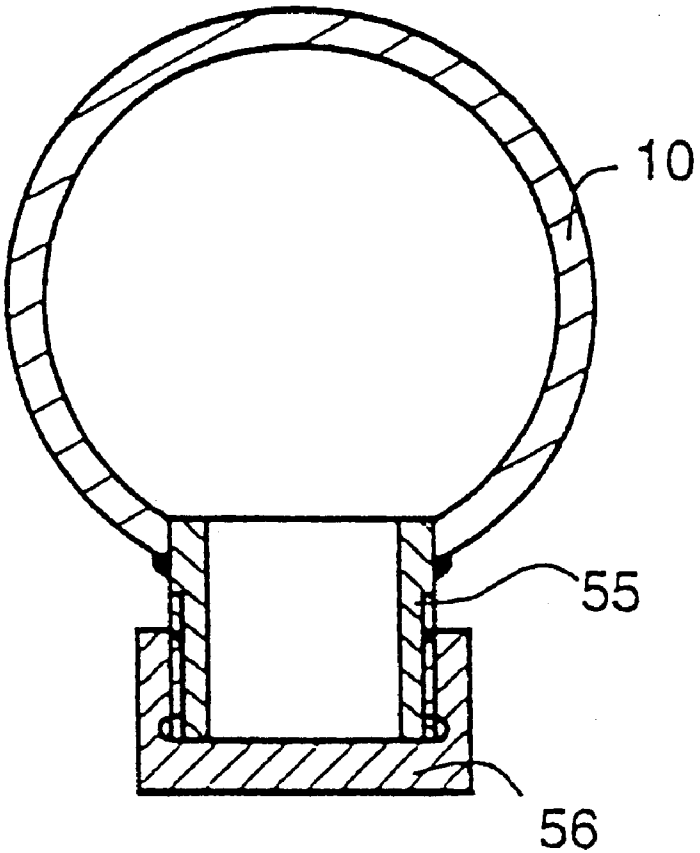
FIGS. 17*a* and 17*b* are side elevation and transverse sectional views, respectively, of embodiments of nozzles which, if desired can be blocked or closed.
Figure 17A:
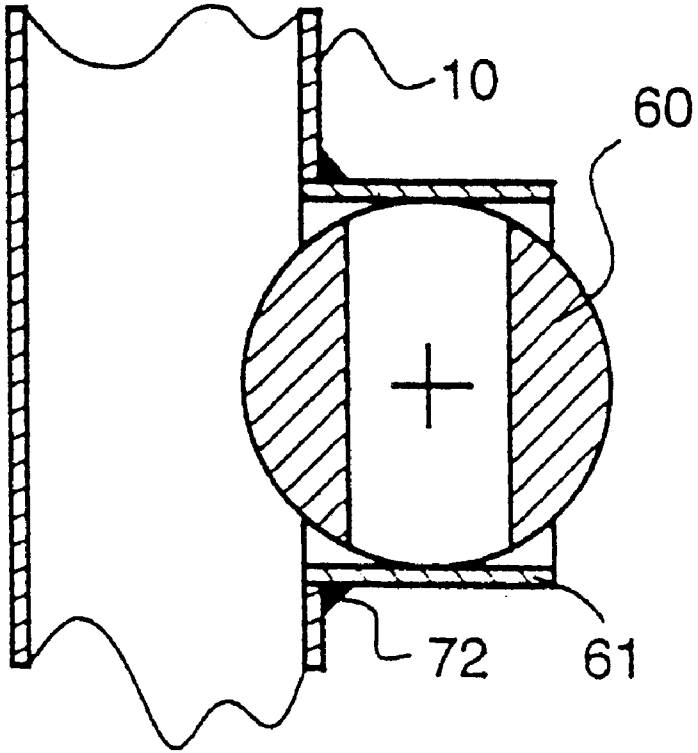

FIGS. 17*a* and 17*b* show two embodiments of nozzles which can be closed or blocked such that no distinct liquid jet can escape from the nozzle 11. In FIG. 17*a*, an embodiment is shown with the principle described in connection with FIGS. 14 and 15*a*–15*c*. Disc nozzle 60 is blocked in a position in which no distinct liquid stream can be formed. Disc nozzle 60 in the shown position cannot, however, block the nozzle completely. A certain amount of liquid can escape. However, because the inventive method is not susceptible to such small disturbances, this kind of incomplete blocking can be tolerated. It is evident that nozzles can also be closed with other simple means, e.g., covers can be attached to the nozzle openings or a pipe nozzle 55 can, as shown in FIG. 17*b*, e.g., be sealed by a union nut 56 serving as a cover.

Figure 18:
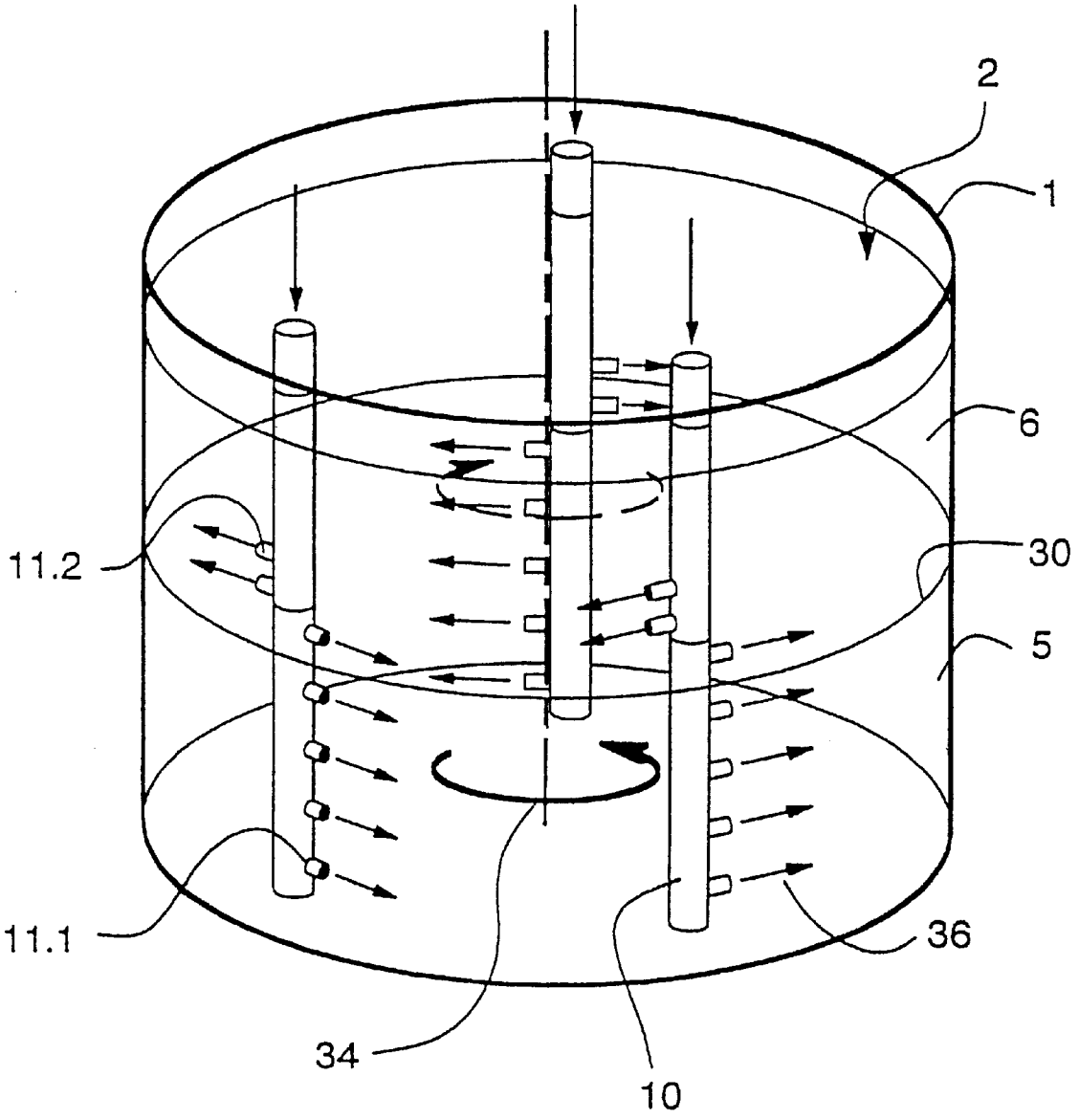
FIG. 18 is a perspective view of a tank having an embodiment of lances with a primary and a secondary row of nozzles which allow the creation of more distinct shear planes.

FIG. 18 schematically shows an embodiment of lances 10 with two rows of nozzles 11.1 or 11.2 which are orientated in substantially opposite directions. The primary rows of nozzles 11.1 on lances 10 are arranged such that they create a circular current around main axis 34 of the vessel in a lower layer 5. The secondary rows of nozzles 11.2 are located directly above the shear plane and contain at least one nozzle 11.2. They are oriented on a direction substantially opposite to the direction of the nozzles of the primary rows, i.e., the liquid ejected by nozzles 11.2 moves the liquid mass directly above shear plane 30 and for the support of this shear plane in the opposite direction to the circular current layer 5. These secondary nozzle rows are advantageously substantially smaller, i.e., contain fewer nozzles than the primary nozzle rows.

As mentioned earlier, due to the inner friction of the liquid, it is in practice difficult to create an ideal shear plane. The orientation of secondary nozzles 11.2 shown in FIG. 18 can, however, considerably facilitate the formation of this kind of distinct shearing plane. If a very thick layer 6 is positioned above the circular current layer 5 it can, regarded from the energy point of view, be of advantage if movement of layer 6 is prevented by creating a distinct shear plane as described above.

Figure 19:
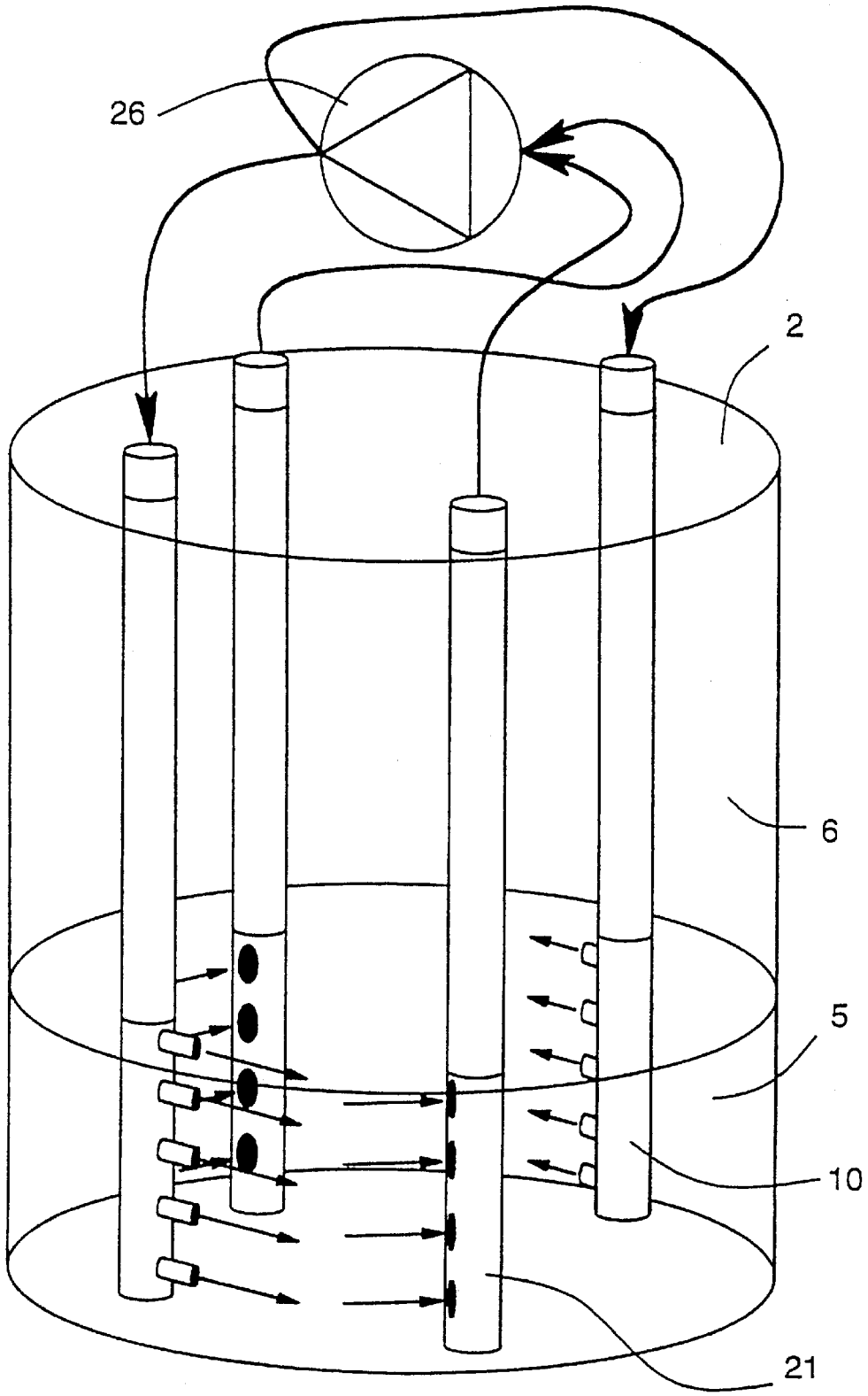
FIG. 19 is a perspective view of a tank with lances operating on the basis of supporting the desired form of disturbance with the help of sucking means.

FIG. 19 schematically shows the principle of an embodiment of lances with suction means 21. It is advantageous if the suction means for the described system are designed as immersion pipes penetrating through the tank roof. For not disturbing the circular current, it may be advantageous to design several suction means such that they even contribute to a certain degree to the formation and maintenance of the current. The suction pipes can, e.g., comprise, as shown in the drawing, in the same way as the lances comprise nozzles, superimposed suction openings positioned in the circular current layer such that the rows of suction openings are oriented substantially downstream. By sucking liquid into the suction openings, the liquid is accelerated and moved accordingly. Thus, by using this kind of immersion pipes directed motion energy can, similarly as with the lances, be introduced into the liquid and thus the efficiency of the whole system can be increased.

Figure 20:
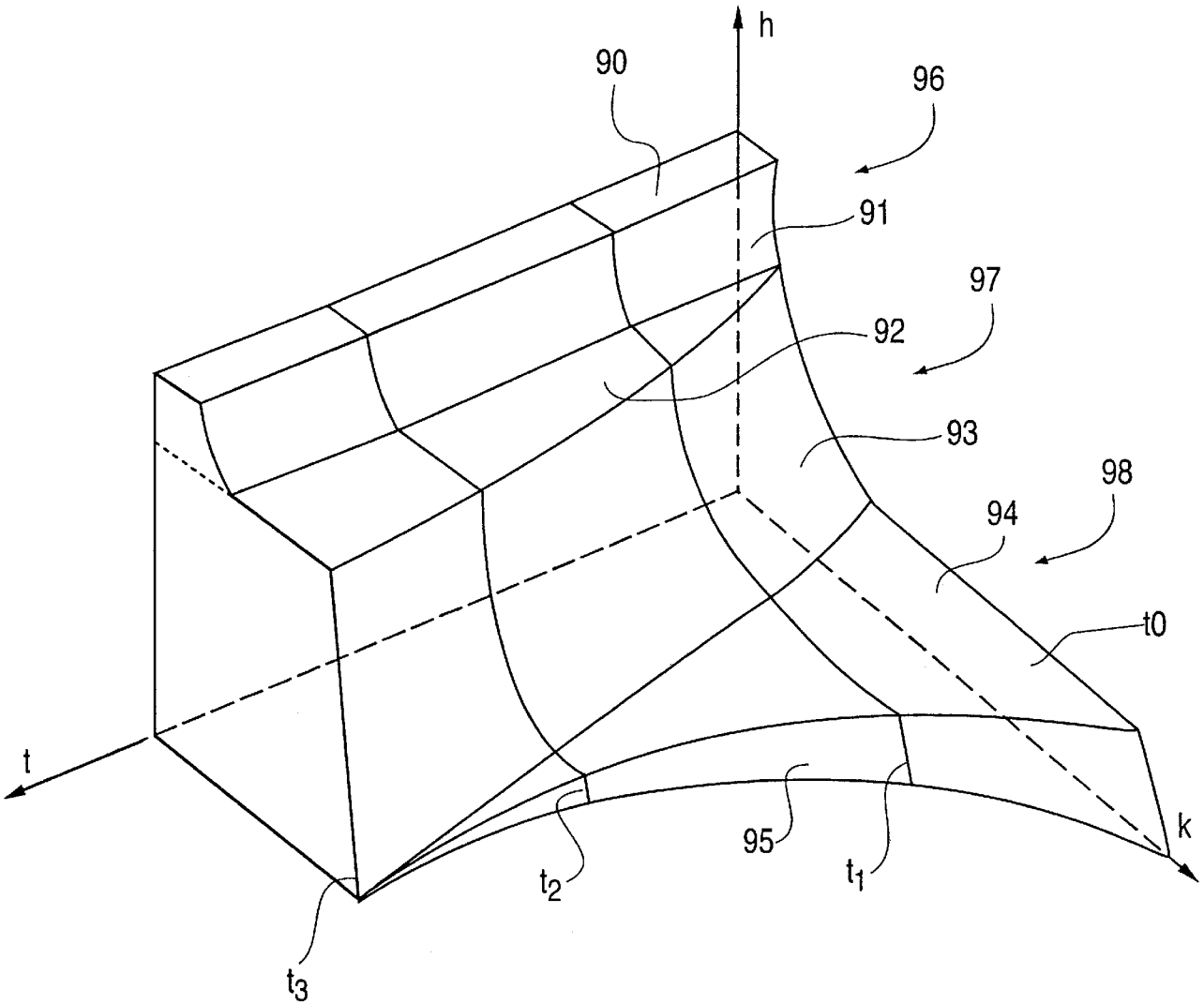
FIG. 20 is a simplified or idealized three-dimensional diagram showing how the inventive method operates.

FIG. 20 shows in a qualitative diagram the inventive method for removing a sediment layer in a crude oil tank. The representation is designed for better understanding of the method and is purely qualitative. The following simplifying assumptions are made:

No fresh liquid is introduced at any time into the system.

The circular current layer is an ideal, friction-free current, which is limited by an ideal shear plane.

The circulation of the liquid only takes place in the circular current layer, i.e., the liquid which is injected into the sediment layer originates from the circular current layer.

The diagram is based on the embodiment of the method according to FIG. 11,

The axes in the diagram are designated as follows: t identifies the time axis, h the height above the tank floor and k stands for the sediment concentration. The diagram contains three important regions. First, region 98 which describes the actual sediment layer; second, region 97 which describes the conditions in the ideal circular current layer; and third, region 96 which describes the resting layer above the circular current layer.

Because this resting layer is protected from the circular current layer by the ideal shear plane, i.e., substantially no mass currents leave this layer or enter it, nothing will change concerning the sediment concentration. Area 90 is a horizontal plane representing the sediment concentration k on the liquid surface. Area 91 describes the sediment concentration k from the liquid surface down to the shear plane remaining constant. The courses of area 90 and 91 do not change with time.

Horizontal area 92 represents the sediment concentration in the shear plane. Its height h is the same as the altitude of the shear plane above the tank floor. It is evident that the sediment concentration k in this layer changes with time. This is due to concentration k in the circular current layer constantly rising with time due to the dissolution of the sediment layer, which fact is also described by area 93 which visualizes the concentration k in the circular current layer above the sediment layer.

Horizontal layer 94 represents the concentration k in the sediment layer. The height of the sediment layer decreases with time and corresponds to the medium height of the sediment layer at each point in time t. It is the object of the method to dissolve or liquefy the thickened sediment layer. This is achieved after a certain time t3 and at this point in time areas 94 and 95 disappear.

If the injected liquid, as described in connection with FIG. 20, originates from the circular current layer itself, then a mass equilibrium develops in the moving layer, i.e., a circulation process takes place. If the liquid is injected from the resting layer above the circular current layer through the lances and the nozzles attached to these, then, if no corresponding amount of liquid is withdrawn continuously from the circular current layer, a mass flow into the region above the circular current layer must take place, which mass flow makes the formation of a distinctive shear plane on the upper border of the circular current layer more difficult.

Concerning energy, it may be advantageous if the injected liquid is taken from the circular current layer because thus the continuity equation in the circular current layer is fulfilled. The thinner the circular current layer to be created the less mass must be brought into motion and the less energy is required. Thus it is advantageous to make the circular current layer as thin as possible by raising and lowering the immersion pipe for removal of liquid to be injected.

In a preferred embodiment of the method, only as much mass as necessary is brought into motion to form the circular current layer, i.e., a volume of crude oil of the size which is required to dissolve the volume of sediment 3 on hand. This minimal volume is determined by the maximal capacity of the injected liquid to take up sediment material. With the help of this saturation value, the minimal volume of the circular current layer in the case of the mentioned circular current layer circulation can be determined. Because in this circulation, liquid, e.g., from upper region 6 of circular current layer 5, is injected through nozzles 11 onto and/or into sediment layer 3, the material removed from the sediment layer substantially stays in circular current layer 5. Sediment layer 3 is gradually dissolved and the concentration of sediment material solved in the crude oil rises up to the complete disappearance of sediment layer 3. If the saturation value of the crude oil is reached before this, the remaining sediment layer 3 is not dissolved any further.

The length of the nozzle rows on lances 10 substantially corresponds to the thickness of the circular current layer 5 and can be matched to the above mentioned calculated minimum thickness by using lances 10 with correspondingly long rows of nozzles 11. In order to avoid special manufacture of such lances 10 the individual nozzles can be designed to be blockable, i.e., by providing means as described above for preventing liquid from being pressed through specified ones of nozzles 11. Thus, it is possible that only a lower part of the nozzle rows, adapted to the circular current layer to be created, is active and nozzles 11 of the upper part are closed or blocked. Suction means 21 can be designed as an immersion pipe with an adjustable height mounted in roof 4 of tank 1 and also adapted to the thickness of circular current layer 5.

Further variants of the described embodiments of the inventive method and the inventive device are, e.g.,the following:

The lances comprise nozzles with different orientations wherein the orientation of each nozzle fulfills the given conditions for current formation.

The lances are branched.

The nozzles are arranged on flexible pressure tubes for support being positioned in guide pipes having slotted windows for the nozzles. This embodiment allows diameter adaptation to the support openings with one only standard part carrying the nozzles. Furthermore, the lances become cheaper.

The method is not applied for removing sediments but for preventing sedimentation by keeping the lances constantly mounted in the supports and by periodically ejecting liquid and temporarily creating a current.

The diagram in FIG. 20 describes a system with ideal circular current layer, i.e., with a distinct shear plane. It is evident that in reality transverse strain develops in the shear plane and this is transmitted by inner friction in the liquid to 'resting layers' 6.1, 6.2. In reality, a speed profile will also develop in layers 6.1 and 6.2, i.e., the liquid masses described as resting layers also move slightly. The model of the ideal circular current layer, however, is used as a basis in the discussion of the invention for better understanding and as simplification.

The main advantages of the inventive method compared to the state of the art are the facts that the device required for carrying out the method operates without moving parts positioned under the surface of the liquid. The pump only contains parts moving in operation. Furthermore, no means for rotating the lances are required. The lances are of very simple design and thus can be manufactured cheaply and without precision (tolerances in the millimeter range). The device may consist of cheap material, e.g., steel 37. Due to the simplicity of the invention, the inventive lances are a lot lighter than rotation lances and thus simpler to handle and less susceptible to mechanical damage, e.g., when being mounted. They are very simple to operate and they do not require special maintenance.

By largely avoiding unnecessary formation of eddies, which, however, is looked at as an advantage of rotation lances, a considerable amount of pumping energy can be saved which makes it possible to use lighter, mobile and cheaper pump units; additionally, the lances are lighter, which increases mobility. Furthermore it is evident that these arrangements, the device (lance) as well as the method (nozzle orientation) require no precision. The whole technique is robust and comprises, as mentioned above, cheap lances and a very simple operation of the method for achieving the desired effect.

It is also advantageous that the tank to be treated need not be emptied. As soon as a sediment layer has formed, the lances can be installed at a given liquid level and the current can be generated. Meanwhile, the tank can remain in full operation; crude oil can be added or removed. Due to the relatively lightweight equipment and the possibility of the use of standard lances (i.e., high numbers of identical lances) in different applications the system is extremely adaptable; e.g., lances from different appliances can be combined or exchanged. Furthermore, the fact that the method can operate perfectly without complicated and expensive control is very advantageous.

The inventive method for recovering crude oil from thickened crude oil or from its sludgy to compact sediments in vessels in which crude oil is stored and/or transported by treating the sediment with crude oil or refinery products as a solvent and at least partly liquefying and dissolving it whereby the solvent is pressed out of nozzles in order to form a current which erodes the sediment and dissolves it as far as this is possible, is substantially characterized by creating a plurality of directed liquid solvent jets ejected from fixed nozzles which are orientated such that the liquid jets drive the surrounding medium sectionwise in a mutual direction, bring it into motion and unite with this medium to form a mutual current.

The device for carrying out the method comprises a hollow body connected to liquid supply means and comprising nozzles through which the liquid is ejected under pressure. The nozzles are arranged over a part of the length of the device wherein a plurality of nozzles is arranged radially fixed and at a distance from each other, the nozzles being orientable or being orientated such that liquid jets can be created of which jets at least a part is substantially parallel.

An arrangement of inventive devices for carrying out the method in a vessel is such that a plurality of nozzles is positioned in nozzle pairs on each one of a pair of current lines ($S_i/S_a$) of a current to be created and such that the nozzles are orientated with a horizontal, radial component ($R_r$) of the injecting directions of the nozzles of one pair being directed in an acute angle towards each other and between the nozzles of a further pair following downstream. Thereby, the liquid jets drive the surrounding medium in a mutual direction and unite with it to form a mutual current. One or several pumps are connected to the lances for supplying these with liquid. For supplying the pump or pumps with liquid, one or several immersion pipes are provided, the suction side of the immersion pipes protruding into the layer to be made to flow or connections for sucking liquid from outside the named layer are provided.

What is claimed is:

1. A method for recovering crude oil from thickened crude oil or from sludgy to compact sediments of crude oil in a vessel is which crude oil is stored or transported, the method comprising the steps of positioning a plurality of nozzles in the vessel so that the nozzles are oriented in a single direction substantially tangential relative to walls of the vessel;

ejecting from the plurality of nozzles a plurality of jets of a liquid solvent under pressure in a direction which is substantially horizontal or at a shallow downward angle, the solvent comprising crude oil or refinery products, to form a generally horizontal current circulating in one direction around the interior of the vessel above the sediment for eroding and liquefying the thickened or sludgy crude oil sediment and dissolving the sediment to the extent it can be dissolved, the liquid jets driving surrounding liquid section-wise in a common direction, moving and uniting with the liquid in a joint current.

2. The method according to claim 1 wherein the circulating liquid current follows a path closed on itself, and wherein the nozzles are positioned above the surface of the sediment, and wherein the shallow angle is between 0° and 10° downward from the horizontal, the liquid ejected from the nozzles having a tangential component ($R_t$) which is tangential to a closed arcuate line of the circulating current path.

3. The method according to claim 2 wherein the jets of liquid ejected from selected ones of the nozzles include a horizontal radial outward component ($R_r$) smaller than the tangential component ($R_t$).

4. The method according to claim 1 wherein the circulating current formed by said jets is circular and centered on a current center in said vessel.

5. The method according to claim 4 wherein the circulating current formed by said jets lies in a predetermined layer in the liquid stored in said vessel and forms shear planes with adjacent layers of liquid such that the adjacent layers are essentially undisturbed by the circulating current.

6. The method according to claim 5 including extracting liquid from the layer having the circulating current and pumping the extracted liquid as the solvent through the nozzles to form the current-driving jets in the circulating current layer.

7. The method according to claim 1 wherein the solvent comprising crude oil or refinery products comprises the same or a smaller concentration of components of high molecular weight than crude oil lying in the vessel above the sediment.

8. The method according to claim 1 wherein the circulating liquid current follows a path closed on itself, and wherein the nozzles are positioned below the surface of the sediment, and wherein the shallow angle is between 0° and 10° downward from the horizontal, the liquid ejected from the nozzles having a tangential component ($R_t$) which is tangential to a closed arcuate line of the circulating current path.

9. The method according to claim 1 wherein the circulating liquid current follows a path closed on itself, and wherein the nozzles are positioned partly above and partly below the surface of the sediment, and wherein the shallow angle is between 0° and 10° downward from the horizontal, the liquid ejected from the nozzles having a tangential component ($R_t$) which is tangential to a closed arcuate line of the circulating current path.

10. A device for creating a plurality of liquid jets of a solvent comprising crude oil or refinery products to form a current for eroding and liquefying the thickened or sludgy crude oil sediment in a vessel and dissolving it to the extent it can be dissolved, the device comprising a plurality of lances, each said lance comprising an elongated hollow body in said vessel;

a connection for supplying said lances with a liquid under pressure;

said lances having a plurality of nozzles (11) spaced apart over over at least part of the length of said lances, said nozzles being oriented to jointly eject substantially parallel liquid jets of said liquid under pressure, thereby creating a substantially unidirectional horizontal liquid current circulating in said vessel, nozzles of different ones of said lances forming pairs, the jet from one nozzle of each pair having a radial flow component intersecting a liquid jet from the other nozzle of said pair at an acute angle, the intersecting jets forming a circular flow component contributing to said unidirectional liquid current layer circulating in said vessel, said device further including a suction lance downstream from said nozzles for extracting liquid from said vessel outside of said layer.

11. A device according to claim 10 wherein each of said nozzles emits a jet of liquid having an ejection direction directed substantially horizontally or at a shallow downward angle, each said jet having a tangential component ($R_t$) tangential to an arcuate line closed on itself and defining a closed path for liquid circulation and a radial component ($R_r$) perpendicular to and smaller than said tangential component.

12. A device according to claim 11 wherein said plurality of nozzles are positioned in a row along a portion of said at least one lance adjacent a bottom surface of said vessel, said nozzles being uniformly spaced from each other, the length of said row being between 2 and 5 meters, whereby at least some of said nozzles are above an upper surface of said sediment.

13. A device according to claim 10 including a plurality of lances uniformly spaced from each other at distances of at least 5 meters.

14. A device for creating a plurality of liquid jets of a solvent comprising crude oil or refinery products to form a current for eroding and liquefying the thickened or sludgy crude oil sediment in a vessel and dissolving it to the extent it can be dissolved, the device comprising a plurality of lances each comprising an elongated hollow body in said vessel;

a connection for supplying said at least one lance with a liquid under pressure;

each said lance having a plurality of nozzles (11) spaced apart over at least part of the length of said lance, said nozzles being oriented to jointly eject substantially parallel liquid jets of said liquid under pressure, thereby creating a substantially horizontal liquid current circulating in said vessel, and a plurality of guides, one guide surrounding each of said lances, each said guide having a vertical slot radially outwardly from said nozzles, each said lance being pivotable about a longitudinal axis to adjust nozzle orientation.

15. A method for recovering crude oil from thickened crude oil or from sludgy to compact sediments of crude oil in a vessel is which crude oil is stored or transported, the method comprising the steps of positioning a plurality of lances at substantially fixed locations in the vessel, each of the lances having a plurality of nozzles positioned in the vessel so that the nozzles are oriented in a generally tangential direction relative to walls of the vessel;

ejecting under pressure from the plurality of nozzles a plurality of jets of a liquid solvent in a direction which is substantially horizontal or at a shallow downward angle, the solvent comprising crude oil or refinery products, to form a generally horizontal current circulating in one direction around the interior of the vessel above the sediment for eroding and liquefying the thickened or sludgy crude oil sediment and dissolving the sediment to the extent it can be dissolved, the liquified or dissolved sediment moving and uniting with the liquid in a unidirectional joint current.

* * * * *